US011568798B2

(12) United States Patent
Xia et al.

(10) Patent No.: US 11,568,798 B2
(45) Date of Patent: Jan. 31, 2023

(54) DISPLAY PANEL AND DISPLAY DEVICE

(71) Applicant: Shanghai Tianma Micro-Electronics Co., Ltd., Shanghai (CN)

(72) Inventors: Xingda Xia, Shanghai (CN); Jujian Fu, Shanghai (CN); Nana Xiong, Shanghai (CN); Yuqi Hu, Shanghai (CN)

(73) Assignee: SHANGHAI TIANMA MICRO-ELECTRONICS CO., LTD., Shanghai (CN)

( * ) Notice: Subject to any disclaimer, the term of this patent is extended or adjusted under 35 U.S.C. 154(b) by 0 days.

(21) Appl. No.: 17/446,932

(22) Filed: Sep. 3, 2021

(65) Prior Publication Data

US 2022/0366834 A1 Nov. 17, 2022

(30) Foreign Application Priority Data

May 17, 2021 (CN) ..... 202110536461.0

(51) Int. Cl.
*G09G 3/325* (2016.01)
*G09G 3/32* (2016.01)

(52) U.S. Cl.
CPC ..... *G09G 3/32* (2013.01); *G09G 2300/0809* (2013.01); *G09G 2310/061* (2013.01); *G09G 2320/0247* (2013.01); *G09G 2330/02* (2013.01)

(58) Field of Classification Search
CPC ..... H01L 27/3265; H01L 27/3248; H01L 27/3262; H01L 27/3276; G09G 3/3233; G09G 2300/0861; G09G 2300/0426; G09G 2320/043; G09G 2310/0262; G09G 3/3241; G09G 2320/045; G09G 2300/043; G09G 2300/0439; G09G 2310/0278; G09G 2310/0272; G09G 3/2007
See application file for complete search history.

(56) References Cited

U.S. PATENT DOCUMENTS

2015/0130691 A1* 5/2015 Jeon ..... G09G 3/3225 345/82
2018/0130420 A1* 5/2018 Gao ..... G09G 3/3233

FOREIGN PATENT DOCUMENTS

CN 111489701 A 8/2020
CN 211480028 U 9/2020
CN 112289267 * 1/2021
CN 112289267 A 1/2021

* cited by examiner

*Primary Examiner* — Duc Q Dinh
(74) *Attorney, Agent, or Firm* — Anova Law Group PLLC

(57) ABSTRACT

A display panel includes a pixel circuit that includes a light emitting module, a driving module, a first dual control module, and a second dual control module. A control end of the driving module is connected to a first node. The first dual control module has a control end connected to a first scanning line and has a first end connected to the first node. A first capacitor is formed between an intermediate node of the first dual control module and a first potential line. The second dual control module has a first end connected to the first node and has a second end connected to the driving module. A second capacitor is formed between an intermediate node of the second dual control module and a second potential line. Capacitance of one of the first capacitor and the second capacitor is greater than another.

20 Claims, 15 Drawing Sheets

10

10

10

10

DISPLAY PANEL AND DISPLAY DEVICE

CROSS-REFERENCE TO RELATED APPLICATION

This application claims the priority to Chinese patent application No. 202110536461.0, filed on May 17, 2021, the entirety of which is incorporated herein by reference.

TECHNICAL FIELD

The present disclosure relates to the technical field of display technology and, more particularly, to a display panel and a display device.

BACKGROUND

With the development of display technology, variable frequency drive technology is gradually applied to display panels. For example, a driving method with a higher refresh rate is used to drive and display motion images (such as for a sports event or a game scene) to ensure display smoothness; while a driving method with a lower refresh rate is used to drive and display a slow motion image or a static image to reduce power consumption. In a low frequency mode, the display panel is prone to having flickering display.

SUMMARY

In accordance with the disclosure, there is provided a display panel including a pixel circuit. The pixel circuit includes a light emitting module, a driving module configured to drive the light emitting module to emit light, a first dual control module, and a second dual control module. The driving module and the light emitting module are connected in series between a first power line and a second power line, and a control end of the driving module is connected to a first node. A control end of the first dual control module is connected to a first scanning line, a first end of the first dual control module is connected to the first node, and a first capacitor is formed between an intermediate node of the first dual control module and a first fixed potential line. A control end of the second dual control module is connected to a second scanning line, a first end of the second dual control module is connected to the first node, a second end of the second dual control module is connected to a first end of the driving module, and a second capacitor is formed between an intermediate node of the second dual control module and a second fixed potential line. Capacitance of the first capacitor is C1, capacitance of the second capacitor is C2, and one of C1 and C2 is greater than another.

Also in accordance with the disclosure, there is provided a display panel including a pixel circuit. The pixel circuit includes a light emitting module, a driving module configured to drive the light emitting module to emit light, a first dual control module, and a second dual control module. The driving module and the light emitting module are connected in series between a first power line and a second power line, and a control end of the driving module is connected to a first node. A control end of the first dual control module is connected to a first scanning line, a first end of the first dual control module is connected to the first node, and a first capacitor is formed between an intermediate node of the first dual control module and a first fixed potential line. A control end of the second dual control module is connected to a second scanning line, a first end of the second dual control module is connected to the first node, a second end of the second dual control module is connected to a first end of the driving module, and a second capacitor is formed between an intermediate node of the second dual control module and a second fixed potential line. Capacitance of the first capacitor is C1, capacitance of the second capacitor is C2, and one of C1 and C2 is greater than another.

Also in accordance with the disclosure, there is provided a display device including a display panel. The display panel includes a pixel circuit. The pixel circuit includes a light emitting module, a driving module configured to drive the light emitting module to emit light, a first dual control module, and a second dual control module. The driving module and the light emitting module are connected in series between a first power line and a second power line, and a control end of the driving module is connected to a first node. A control end of the first dual control module is connected to a first scanning line, a first end of the first dual control module is connected to the first node, and a first capacitor is formed between an intermediate node of the first dual control module and a first fixed potential line. A control end of the second dual control module is connected to a second scanning line, a first end of the second dual control module is connected to the first node, a second end of the second dual control module is connected to a first end of the driving module, and a second capacitor is formed between an intermediate node of the second dual control module and a second fixed potential line. Capacitance of the first capacitor is C1, capacitance of the second capacitor is C2, and one of C1 and C2 is greater than another.

According to the display panel and the display device provided by the embodiments of the present disclosure, on one hand, the first capacitor connected between the first intermediate node and the first fixed potential line as well as the second capacitor connected between the second intermediate node and the second fixed potential line are added. When the signal of the first scanning line changes from low voltage to high voltage, due to the coupling effect of the first parasitic capacitor, the potential of the first intermediate node tends to increase. However, the first capacitor is electrically coupled to the first fixed potential line, and due to a coupling effect of the first capacitor, the potential of the first intermediate node tends to remain unchanged. Therefore, due to the existence of the first capacitor, increasing amplitude of the potential of the first intermediate node can be reduced or the potential of the first intermediate node can remain unchanged. Similarly, when the signal of the second scanning line changes from low voltage to high voltage, due to the coupling effect of the second parasitic capacitor, the potential of the second intermediate node tends to increase. However, the second capacitor is electrically coupled to the second fixed potential line, and due to a coupling effect of the second capacitor, the potential of the second intermediate node tends to remain unchanged. Therefore, due to the existence of the second capacitor, increasing amplitude of the potential of the second intermediate node can be reduced or the potential of the second intermediate node can remain unchanged. On the other hand, capacitance C1 of the first capacitor and capacitance C2 of the second capacitor are not equal, that is, a degree to which the first capacitor maintains the potential of the first intermediate node is different from a degree to which the second capacitor maintains the potential of the second intermediate node. For example, when the current $I_{N1\text{-}N5}$ is less than the current $I_{N1\text{-}N6}$, the capacitance C1 of the first capacitor can be set to be greater than the capacitance C2 of the second capacitor, so that the first capacitor has a stronger potential maintenance effect on the first intermediate node, which makes the increasing amplitude of the potential of the first intermediate node smaller. That is, the potential of the first intermediate node is maintained at a smaller negative potential, thereby increasing the current $I_{N1-N5}$, so that the current $I_{N1-N5}$ is equal to the current $I_{N1-N6}$, and the potential of the first node can maintain dynamic balance. Similarly, when the current $I_{N1-N5}$ is greater than the current $I_{N1-N6}$, the capacitance C1 of the first capacitor can be set to be smaller than the capacitance C2 of the second capacitor, so that the first capacitor has a weaker potential maintenance effect on the first intermediate node, which makes the increasing amplitude of the potential of the first intermediate node larger. That is, the potential of the first intermediate node changes to a positive potential, thereby reducing the current $I_{N1-N5}$, so that the current $I_{N1-N5}$ is equal to the current $I_{N1-N6}$, and the potential of the first node can maintain dynamic balance.

It should be understood that the above general description and the following detailed description are only exemplary and explanatory, and do not limit the present disclosure.

BRIEF DESCRIPTION OF THE DRAWINGS

The drawings here are incorporated into the specification and constitute a part of the specification, showing the embodiments conforming to the present disclosure and being used to explain the principle of the present disclosure together with the specification, which do not constitute an improper limitation to the present disclosure.

DETAILED DESCRIPTION OF THE EMBODIMENTS

The features and exemplary embodiments of the present disclosure will be described in detail below. In order to make the objectives, technical solutions, and advantages of the embodiments of the present disclosure clearer, the present disclosure will be further described in detail below in combination with the accompanying drawings and specific embodiments. It should be understood that the specific embodiments described herein are only configured to explain the present disclosure rather than limit the present disclosure. The present disclosure can be implemented without some of these specific details for those skilled in the art. The following description of the embodiments is only to provide a better understanding of the present disclosure by showing examples of the present disclosure.

It should be noted that, relational terms herein such as first and second are only used to distinguish one entity or operation from another entity or operation, and do not necessarily require or imply any such actual relationship or order between these entities or operations.

It should be understood that when the structure of a component is described, when a layer or area is referred to as being "on" or "above" another layer or another area, it can indicate being directly on another layer or another area, or there also includes other layers or areas between it and another layer or another area. Also, if the component is turned over, the layer or area will be "under" or "below" another layer or another area.

The embodiments of the present disclosure provide a display panel and a display device, which will be described in detail below by specific embodiments in conjunction with the accompanying drawings.

The display panel provided by the embodiments of the present disclosure can support a low frequency mode and a high frequency mode. For example, the low frequency mode can include a refresh rate less than 60 Hz, such as 30 Hz, 15 Hz, etc. The high frequency mode can include a refresh rate greater than or equal to 60 Hz, such as 60 Hz, 90 Hz, 120 Hz, 144 Hz, etc.

Figure 1:
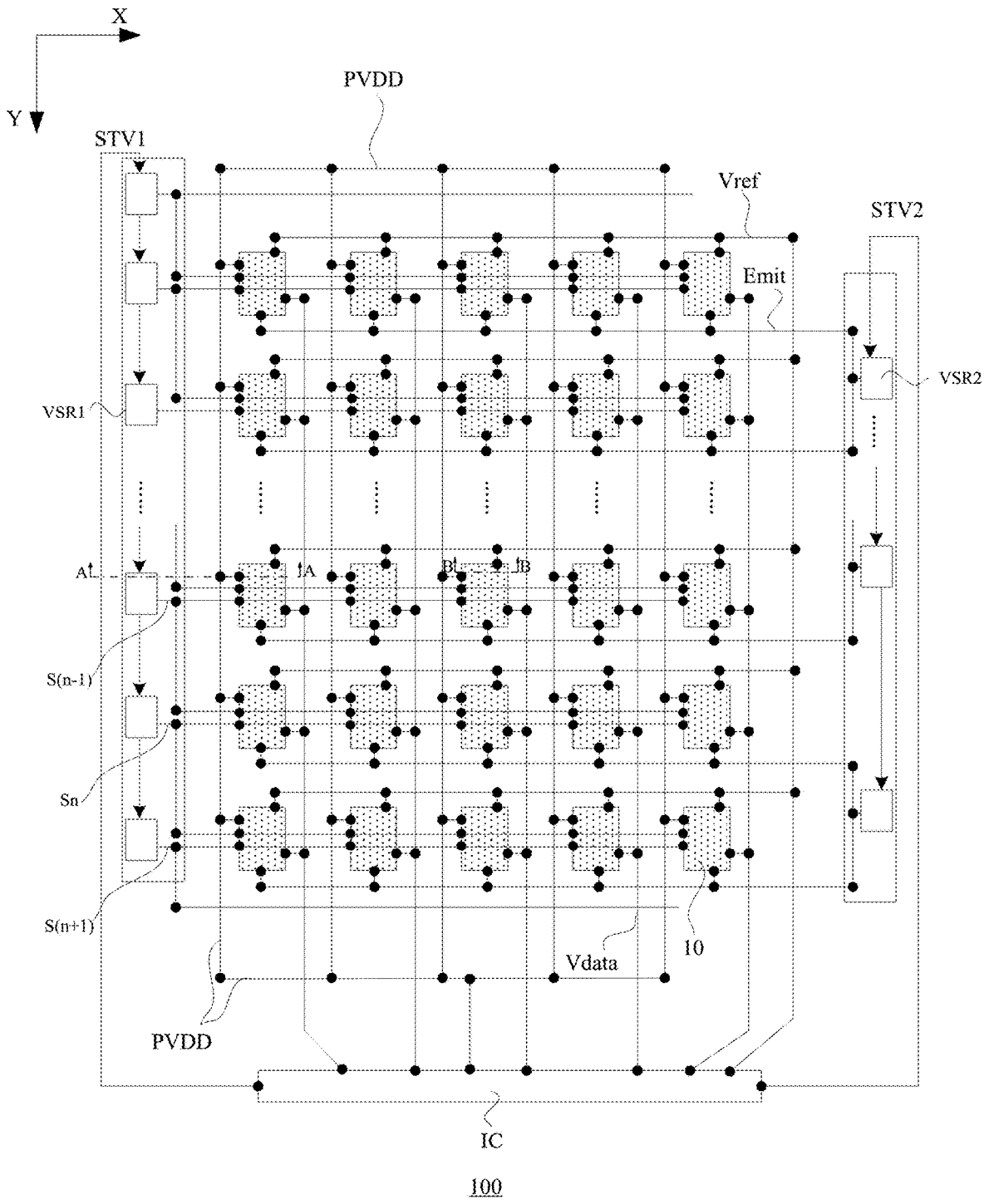
FIG. 1 illustrates a schematic top view of a display panel according to an embodiment of the present disclosure.

As shown in FIG. 1, a display panel 100 provided by the embodiments of the present disclosure includes a plurality of pixel circuits 10. The plurality of pixel circuits 10 are arranged in arrays. For example, the plurality of pixel circuits 10 are arranged in arrays in intersecting first direction X and second direction Y. For example, the first direction X is a row direction, and the second direction Y is a column direction. As another example, the first direction X may also be a column direction, and the second direction Y may also be a row direction.

Exemplarily, the display panel 100 also include a driver chip IC, a plurality of cascaded first shift registers VSR1, a plurality of cascaded second shift registers VSR2, a first power line PVDD, a data signal line Vdata, a reference voltage line Vref, scanning lines S(n−1), Sn, S(n+1), and a light emission control signal line Emit.

The first shift registers VSR1 in various stages are electrically coupled to the pixel circuits 10 via the scanning lines, and the first shift registers VSR1 are configured to provide scanning signals to the pixel circuits 10. The driver chip IC provides a first start signal STV1 for the first shift register VSR1 in first stage. In addition, as shown in FIG. 1, in the plurality of cascaded first shift registers VSR1, except for the first shift registers VSR1 in the first stage and last stage, the remaining first shift registers VSR1 can provide scanning signals for two adjacent rows of the pixel circuits 10. In this case, two rows of dummy pixel circuits (not shown in FIG. 1) can be arranged on the display panel, which are respectively connected to the scanning lines of the first shift registers VSR1 in the first stage and the last stage among the first shift registers VSR1, and the dummy pixel circuits may not be used for display.

The second shift registers VSR2 in various stages are electrically coupled to two adjacent rows of the pixel circuits 10 via the light emission control signal lines Emit, and the second shift registers VSR2 are configured to provide light emission control signals to two adjacent rows of the pixel circuits 10. The driver chip IC provides a second start signal STV2 for the second shift register VSR2 in the first stage.

In addition, a clock signal line (not shown in the figure), a high voltage signal line VGH (not shown in the figure), and a low voltage signal line VGL (not shown in the figure) may be connected between the first shift register VSR1 and the driver chip IC and between the second shift register VSR2 and the driver chip IC, where the driver chip IC provides a clock signal, a high voltage signal, and a low voltage signal to the first shift register VSR1 and the second shift register VSR2.

For example, as shown in FIG. 1, the display panel 100 may include one first shift register VSR1 and one second shift register VSR2, where the first shift register VSR1 and the second shift register VSR2 may be arranged on opposite sides of the display panel 100 in the second direction Y, or the first shift register VSR1 and the second shift register VSR2 may also be arranged on the same side.

As another example, the display panel 100 may also include two first shift registers VSR1 and two second shift registers VSR2, where two ends of the scanning line are electrically coupled to the two first shift registers VSR1 respectively, and two ends of the light emission control signal line Emit are electrically coupled to the two second shift registers VSR2 respectively.

As another example, the display panel 100 includes two first shift registers VSR1, where one of the first shift registers VSR1 is electrically coupled to the pixel circuits in odd rows via the scanning line, and the other first shift register VSR1 is electrically coupled to the pixel circuits in even rows via the scanning line.

As another example, the display panel 100 includes two second shift registers VSR2, where one of the second shift registers VSR2 is electrically coupled to the pixel circuits in odd rows via the light emission control signal line, and the other second shift register VSR2 is electrically coupled to the pixel circuits in even rows via the light emission control signal line.

Exemplarily, a shift register that can simultaneously generate the scanning signal and the light emission control signal may also be provided.

Figure 2:
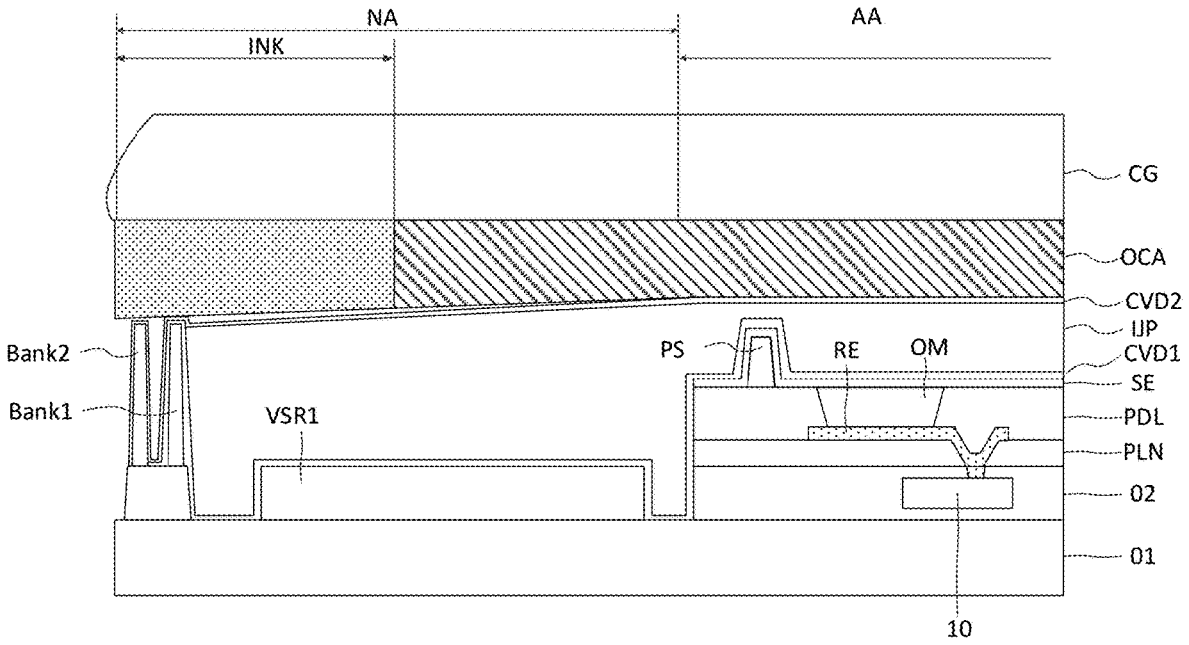
FIG. 2 illustrates a schematic cross-sectional view along A-A direction in the display panel of FIG. 1 according to an embodiment of the present disclosure.
Figure 3:
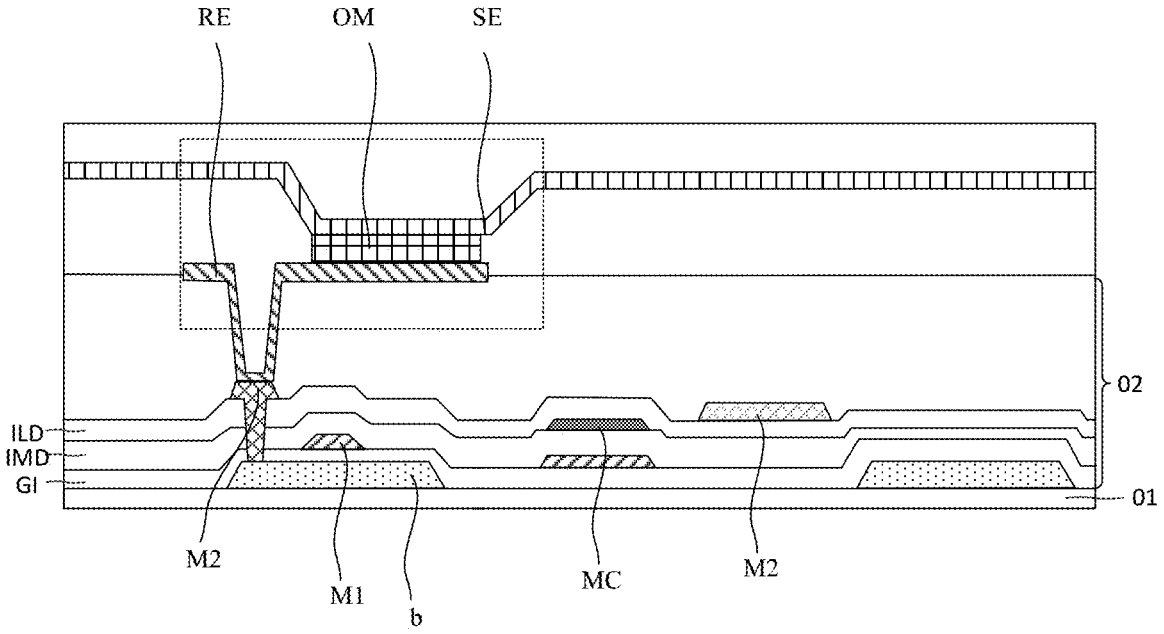
FIG. 3 illustrates a schematic cross-sectional view along B-B direction in the display panel of FIG. 1 according to another embodiment of the present disclosure.

In order to better understand the structure of the display panel provided by the embodiments as a whole, reference can be made to FIGS. 2 and 3. As shown in FIG. 2, the display panel includes a display area AA and a non-display area NA, and the non-display area NA includes an ink area INK. Exemplarily, the display panel includes a substrate 01 and a driving circuit layer 02 arranged at one side of the substrate 01. FIG. 2 also illustrates a planarization layer PLN, a pixel definition layer PDL, a light emission element (the light emission element includes an anode RE, an organic light emission layer OM, and a cathode SE), a support pillar PS, a thin film encapsulation layer (including a first inorganic layer CVD1, an organic layer IJP, and a second inorganic layer CVD2), an optical adhesive layer OCA, and a cover plate CG. In addition, FIG. 2 also illustrates the first shift register VSR1, a first retaining wall Bank1, and a second retaining wall Bank2. The first shift register VSR1 can be arranged in the non-display area NA of the driving circuit layer 02.

The pixel circuit 10 is arranged in the driving circuit layer 02, and the pixel circuit 10 is connected to the anode RE of the light emission element. As shown in FIG. 3, the driving circuit layer 02 of the display panel includes a gate metal layer M1, a capacitor metal layer MC, and a source drain metal layer M2 stack arranged in a direction away from the substrate 01. A semiconductor layer b is arranged between the gate metal layer M1 and the substrate 01. Insulating layers are arranged between the metal layers as well as between the semiconductor layer b and the gate metal layer M1. Exemplarily, a gate insulating layer GI is provided between the gate metal layer M1 and the semiconductor layer b, a capacitor insulating layer IMD is provided between the capacitor metal layer MC and the gate metal layer M1, and an interlayer dielectric layer ILD is provided between the source drain metal layer M2 and the capacitor metal layer MC.

The semiconductor layer b is a semiconductor layer where an active layer of a transistor is located, the gate metal layer M1 is a metal conductive layer where a gate of the transistor is located, the capacitor metal layer MC is a metal conductive layer where one plate of a capacitor is located, and the source drain metal layer M2 is a metal conductive layer where a source and drain of the transistor are located.

Exemplarily, the scanning line and the light emission control signal line Emit may be arranged on the gate metal layer M1. The reference voltage line Vref may be arranged on the capacitor metal layer MC, and the first power line PVDD and the data signal line Vdata may be arranged on the source drain metal layer M2.

Figure 4:
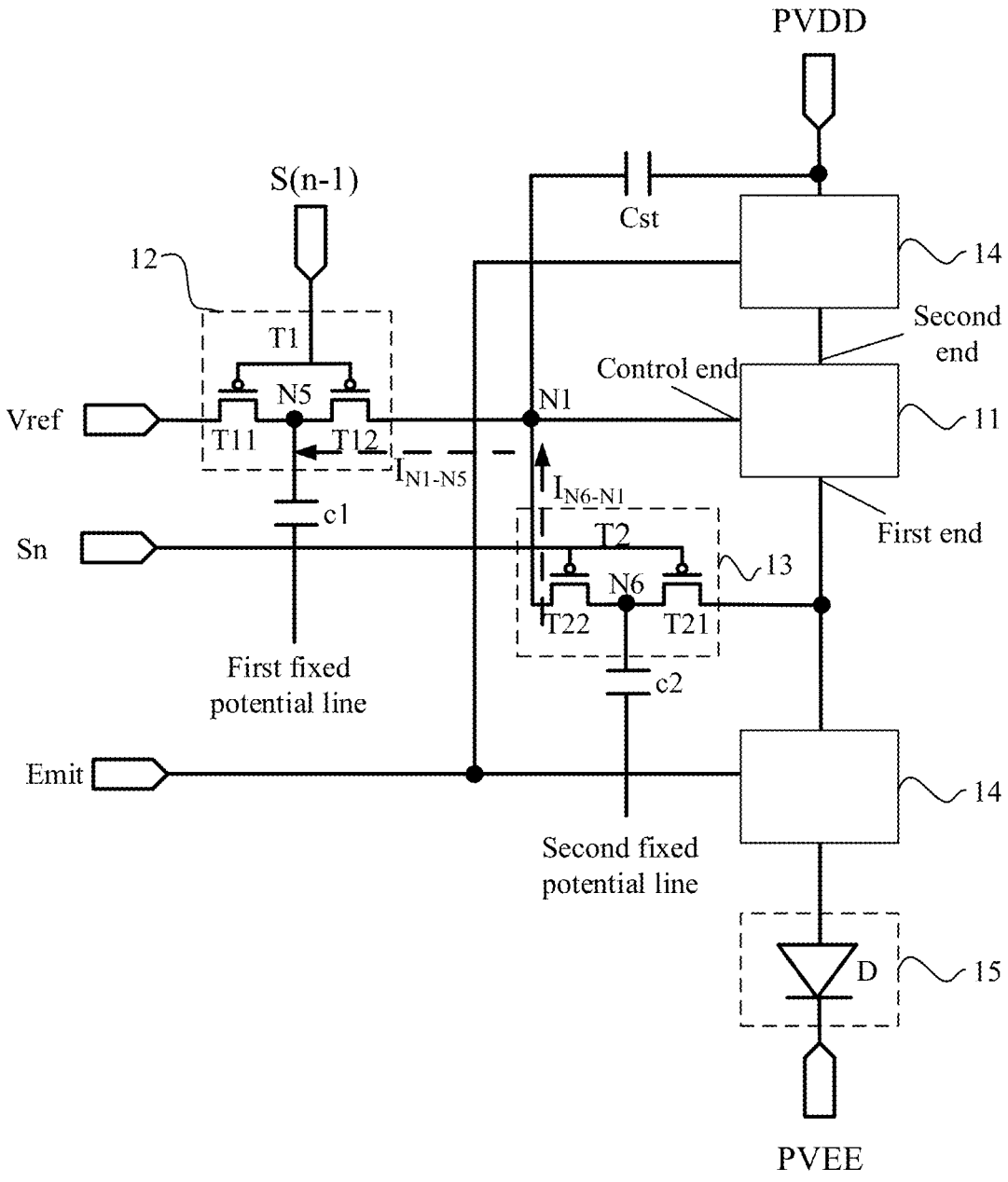
FIG. 4 illustrates a schematic circuit structure diagram of a pixel circuit according to an embodiment of the present disclosure.

As shown in FIG. 4, the pixel circuit 10 includes a driving module 11, a first dual control module 12, a second dual control module 13, and a light emitting module 15.

The driving module 11 and the light emitting module 15 are connected in series between the first power line PVDD and a second power line PVEE, where the driving module 11 is configured to drive the light emitting module 15 to emit light, and a control end of the driving module 11 is connected to a first node N1. A control end of the first dual control module 12 is connected to a first scanning line S(n−1), a first end of the first dual control module 12 is connected to the first node N1, and there is a first capacitor c1 between an intermediate node N5 (hereinafter referred to as a first intermediate node N5) of the first dual control module 12 and a first potential line (e.g., a first fixed potential line). A control end of the second dual control module 13 is connected to a second scanning line Sn, a first end of the second dual control module 13 is connected to the first node N1, a second end of the second dual control module 13 is connected to a first end of the driving module 11, and there is a second capacitor c2 between an intermediate node N6 (hereinafter referred to as a second intermediate node N6) of the second dual control module 13 and a second potential line (e.g., a second fixed potential line). Capacitance of the first capacitor c1 is C1, and capacitance of the second capacitor c2 is C2, where one of C1 and C2 is greater than the other.

The first fixed potential line and the second fixed potential line are configured to provide constant potentials. Exemplarily, the first fixed potential line and the second fixed potential line can be configured to provide constant positive potentials or negative potentials. The potentials provided by the first fixed potential line and the second fixed potential line may be the same or different.

Exemplarily, the light emitting module 15 includes at least one light emission element D, which can be an organic light-emitting diode (OLED).

Exemplarily, the first dual control module 12 and the second dual control module 13 may both include dual gate transistors. In an example where the first dual control module 12 includes a first dual gate transistor T1 including a first sub-transistor T11 and a second sub-transistor T12 connected in series, and the second dual control module 13 includes a second dual gate transistor T2 including a third sub-transistor T21 and a fourth sub-transistor T22 connected in series, the first intermediate node N5 is a connection point between the first sub-transistor T11 and the second sub-transistor T12, and the second intermediate node N6 is a connection point between the third sub-transistor T21 and the fourth sub-transistor T22.

Exemplarily, a second electrode of the first sub-transistor T11 and a first electrode of the second sub-transistor T12 are connected in the first intermediate node N5, and a second electrode of the third sub-transistor T21 and a first electrode of the fourth sub-transistor T22 are connected in the second intermediate node N6. A first parasitic capacitor is formed between the second electrode of the first sub-transistor T11, the first electrode of the second sub-transistor T12, as well as the first intermediate node N5 and two gates of the first dual gate transistor T1. A second parasitic capacitor is formed between the second electrode of the third sub-transistor T21, the first electrode of the fourth sub-transistor T22, as well as the second intermediate node N6 and two gates of the second dual gate transistor T2.

The first scanning line S(n−1) controls on or off of the first dual gate transistor T1, and the second scanning line Sn controls on or off of the second dual gate transistor T2.

In the following embodiments, a case in which the first dual gate transistor T1 and the second dual gate transistor T2 in the pixel circuit 10 are both P-type transistors is taken as an example for description. For the P-type transistor, a voltage at which it is turned on is controlled to be low, and a voltage at which it is turned off is controlled to be high.

Figure 5:
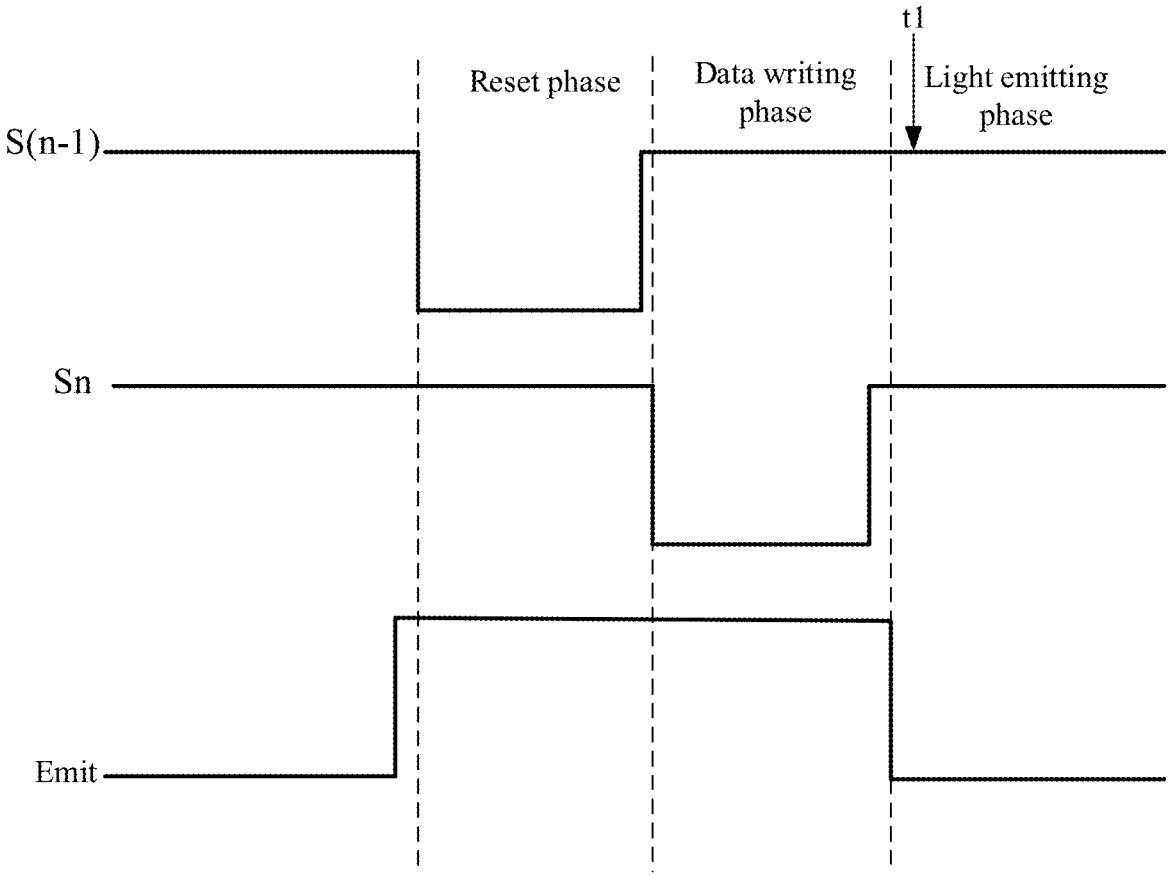
FIG. 5 illustrates a timing diagram of FIG. 4.

As shown in FIG. 5, a driving process of the pixel circuit includes a reset phase, a data writing phase, and a light emitting phase. In the reset phase, the first scanning line S(n−1) provides the low voltage signal, and the first dual gate transistor T1 is turned on. In the data writing phase, the second scanning line Sn provides the low voltage signal, and the second dual gate transistor T2 is turned on. In the light emitting phase, the light emission control signal line Emit provides the low voltage signal, and driving current generated by the driving module 11 is transmitted to the light emitting module 15, so that the light emitting module 15 emits light.

Figure 6:
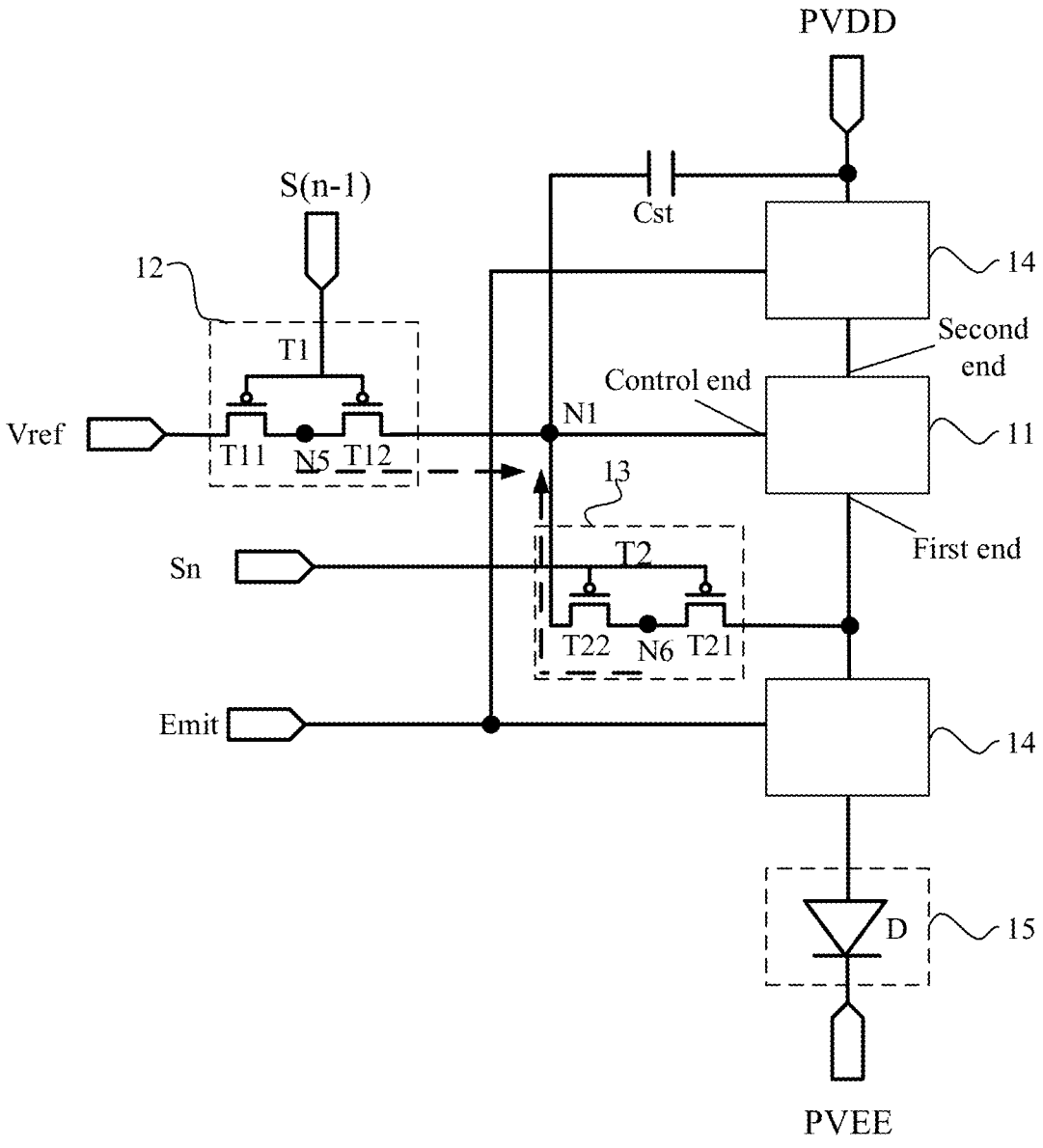
FIG. 6 illustrates a schematic circuit structure diagram of a pixel circuit according to another embodiment of the present disclosure.
Figure 7:
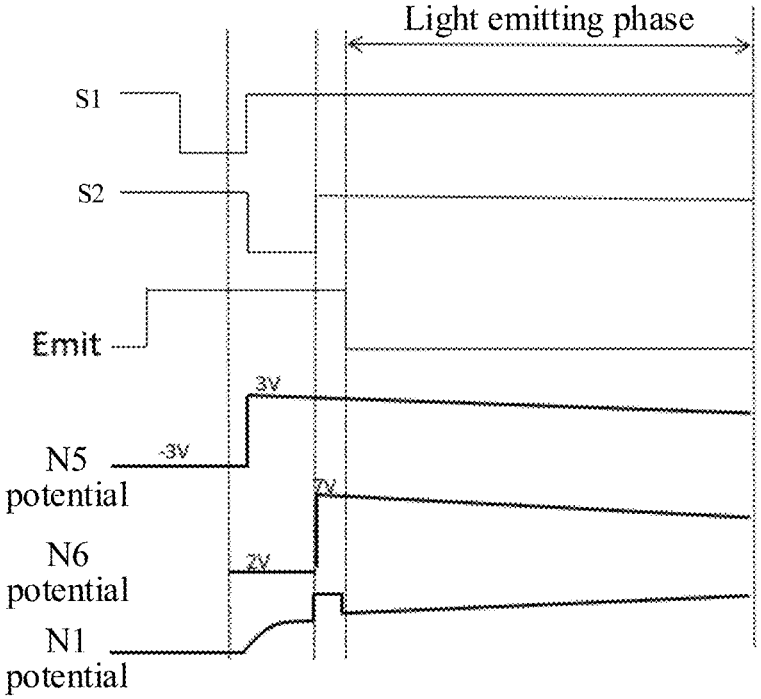
FIG. 7 illustrates a schematic diagram of a node potential of FIG. 6.

As shown in FIG. 6, FIG. 6 differs from FIG. 4 in that the pixel circuit 10 does not include the first capacitor and the second capacitor. Referring to FIGS. 6 and 7, when a signal of the first scanning line S(n−1) changes from low voltage to high voltage, gate potential of the first dual gate transistor T1 also changes from low voltage to high voltage. Due to a coupling effect of the first parasitic capacitor, potential of the first intermediate node N5 increases accordingly, for example, changes from −3V to 3V. Similarly, when a signal of the second scanning line Sn changes from low voltage to high voltage, gate potential of the second dual gate transistor T2 also changes from low voltage to high voltage. Due to a coupling effect of the second parasitic capacitor, potential of the second intermediate node N6 increases accordingly, for example, changes from 2V to 7V. In the light emitting phase, there is a situation where the potentials of the first intermediate node N5 and the second intermediate node N6 are higher than potential of the first node N1 (that is, potential of the control end of the driving module 11), and the first intermediate node N5 and the second intermediate node N6 leak electricity to the control end of the driving module 11, which increases the potential of the control end of the driving module 11, thereby affecting brightness of the light emitting module 15 and causing problem of screen flickering on the display panel.

While in the embodiments of the present disclosure, the first capacitor c1 connected between the first intermediate node N5 and the first fixed potential line as well as the second capacitor c2 connected between the second intermediate node N6 and the second fixed potential line are added. When the signal of the first scanning line S(n−1) changes from low voltage to high voltage, due to the coupling effect of the first parasitic capacitor, the potential of the first intermediate node N5 tends to increase. However, the first capacitor c1 is electrically coupled to the first fixed potential line, and due to a coupling effect of the first capacitor c1, the potential of the first intermediate node N5 tends to remain unchanged. Therefore, due to the existence of the first capacitor c1, increasing amplitude of the potential of the first intermediate node N5 can be reduced or the potential of the first intermediate node N5 can remain unchanged. Similarly, when the signal of the second scanning line Sn changes from low voltage to high voltage, due to the coupling effect of the second parasitic capacitor, the potential of the second intermediate node N6 tends to increase. However, the second capacitor c2 is electrically coupled to the second fixed potential line, and due to a coupling effect of the second capacitor c2, the potential of the second intermediate node N6 tends to remain unchanged. Therefore, due to the existence of the second capacitor c2, increasing amplitude of the potential of the second intermediate node N6 can be reduced or the potential of the second intermediate node N6 can remain unchanged.

As shown in FIG. 4, the first capacitor c1 and the second capacitor c2 can maintain the potentials. The first dual control module 12 and the second dual control module 13 are both in an off state in the light emitting phase. The potential of the first intermediate node N5 is lower than the potential of the first node N1, and the potential of the second intermediate node N6 is higher than the potential of the first node N1, so that there are potential differences between the first node N1 and the first intermediate node N5 and between the first node N1 and the second intermediate node N6. Therefore, in the light emitting phase, the first dual control module 12 and the second dual control module 13 will have current leakage problems. Specifically, current $I_{N1\text{-}N5}$ flows from the first node N1 to the first intermediate node N5, and current $I_{N1\text{-}N6}$ flows from the second intermediate node N6 to the first node N1, so that the potential of the first node N1 can maintain dynamic balance only when the current $I_{N1\text{-}N5}$ is equal to the current $I_{N1\text{-}N6}$.

While in the embodiments of the present disclosure, capacitance C1 of the first capacitor c1 and capacitance C2 of the second capacitor c2 are not equal, that is, a degree to which the first capacitor c1 maintains the potential of the first intermediate node N5 is different from a degree to which the second capacitor c2 maintains the potential of the second intermediate node N6. For example, when the current $I_{N1\text{-}N5}$ is less than the current $I_{N1\text{-}N6}$, the capacitance C1 of the first capacitor c1 can be set to be greater than the capacitance C2 of the second capacitor c2, so that the first capacitor c1 has a stronger potential maintenance effect on the first intermediate node N5, which makes the increasing amplitude of the potential of the first intermediate node N5 smaller. That is, the potential of the first intermediate node N5 is maintained at a smaller negative potential, thereby increasing the current $I_{N1-N5}$, so that the current $I_{N1-N5}$ is equal to the current $I_{N1-N6}$, and the potential of the first node N1 can maintain dynamic balance. Similarly, when the current $I_{N1-N5}$ is greater than the current $I_{N1-N6}$, the capacitance C1 of the first capacitor c1 can be set to be smaller than the capacitance C2 of the second capacitor c2, so that the first capacitor c1 has a weaker potential maintenance effect on the first intermediate node N5, which makes the increasing amplitude of the potential of the first intermediate node N5 larger. That is, the potential of the first intermediate node N5 changes to a positive potential, thereby reducing the current $I_{N1-N5}$, so that the current $I_{N1-N5}$ is equal to the current $I_{N1-N6}$, and the potential of the first node N1 can maintain dynamic balance.

Therefore, according to the embodiments of the present disclosure, the potential of the first node N1 can be maintained, so as to solve the problem that the display panel is prone to flickering in the low frequency mode.

Exemplarily, each row of the pixel circuits 10 used for display are at least correspondingly connected with the first scanning line and the second scanning line.

In some embodiments, the capacitance C1 of the first capacitor c1 and the capacitance C2 of the second capacitor c2 can be set as: 0 fF<C1<8 fF, and 0 fF<C2<8 fF.

The first capacitor c1 and the second capacitor c2 are also equivalent to the parasitic capacitors of the pixel circuit 10. When the capacitances of the first capacitor c1 and the second capacitor c2 are large, there is a negative impact on charging of the control end of the driving module, such as causing a slow charging speed of the control end of the driving module. When the capacitance of the first capacitor c1 and the capacitance of the second capacitor c2 are both set to be between 0 fF and 8 fF, the negative impact on the charging of the control end of the driving module can be avoided, such as avoiding causing the slow charging speed of the control end of the driving module.

In some embodiments, when the capacitance of the first capacitor c1 and the capacitance of the second capacitor c2 are both set to be between 0 fF and 8 fF, the capacitance C1 of the first capacitor c1 and the capacitance C2 of the second capacitor c2 can be further set as: 4 fF≤C1+C2≤8 fF.

The capacitance C1 of the first capacitor c1 and the capacitance C2 of the second capacitor c2 are set as 4 fF≤C1+C2≤8 fF, so that the potential of the first node N1 can be maintained to solve the problem that the display panel is prone to flickering in the low frequency mode, and meanwhile, the negative impact on the charging of the control end of the driving module can be better avoided, such as better avoiding causing the slow charging speed of the control end of the driving module.

The smaller the potential difference between the first intermediate node N5 and the first node N1, the smaller the leakage current between the first intermediate node N5 and the first node N1. Similarly, the smaller the potential difference of the second intermediate node N6 and the first node N1, the smaller the leakage current between the second intermediate node N6 and the first node N1. The ratio of the capacitance C1 of the first capacitor c1 and the capacitance C2 of the second capacitor c2 can be set, for example, the difference between the capacitance C1 of the first capacitor c1 and the capacitance C2 of the second capacitor c2 can be controlled in a small range, so that the potential changes of the first intermediate node N5 and the second intermediate node N6 are close, thereby ensuring the potential difference between the first intermediate node N5 and the first node N1 and the potential difference between the second intermediate node N6 and the first node N1 are both in a small range, which causes the current $I_{N1-N5}$ and the current $I_{N1-N6}$ tend to be the same in value and opposite in direction.

Specifically, in some embodiments, the ratio of the capacitance C1 of the first capacitor c1 and the capacitance C2 of the second capacitor c2 can be set as: 0<|C1−C2|/|C1+C2|≤⅓. By setting the ratio of the capacitance C1 of the first capacitor c1 and the capacitance C2 of the second capacitor c2 in the above manner, the potential difference between the first intermediate node N5 and the first node N1 and the potential difference between the second intermediate node N6 and the first node N1 are both in a small range, so that the current IN1-N5 and the current IN1-N6 tend to be the same in value and opposite in direction, and the potential of the first node N1 can maintain dynamic balance.

In some embodiments, in the case of 0<|C1−C2|/|C1+C2|≤⅓, the ranges of the capacitance C1 of the first capacitor c1 and the capacitance C2 of the second capacitor c2 can be: 2 fF≤C1≤4 fF, and 2 fF≤C2≤4 fF.

For example, C1=2 fF, C2=1 fF. As another example, C1=1 fF, C2=2 fF. As another example, C1=4 fF, C2=2 fF. As another example, C1=2 fF, C2=4 fF. As another example, C1=3 fF, C2=2 fF. As another example, C1=2 fF, C2=3 fF. As another example, C1=4 fF, C2=3 fF. As another example, C1=3 fF, C2=4 fF, etc.

The potential of the first node N1 in an initial phase of the light emitting phase is a. The ratio of the capacitance C1 of the first capacitor c1 and the capacitance C2 of the second capacitor c2 can be set, for example, the capacitance C1 of the first capacitor c1 is set to be larger, and the capacitance C2 of the second capacitor c2 is set to be smaller, so that the potential of the first intermediate node N5 is lower than the potential of the first node N1 by a suitable value c, and the potential of the second intermediate node N6 is higher than the potential of the first node N1 by a suitable value b, which causes the current $I_{N1-N5}$ and the current $I_{N1-N6}$ tend to be the same in value and opposite in direction, and the potential change of the first node N1 is small.

Specifically, the ratio of the capacitance C1 of the first capacitor c1 and the capacitance C2 of the second capacitor c2 can be: ⅔≤|C1−C2|/|C1+C2|<1. By setting the ratio of the capacitance C1 of the first capacitor c1 and the capacitance C2 of the second capacitor c2 in the above manner, the potential of the first intermediate node N5 is lower than the potential of the first node N1 by a suitable value, and the potential of the second intermediate node N6 is higher than the potential of the first node N1 by a suitable value, that is, it is easy to realize that the values of the difference c and the difference b are the same or similar, so that the current $I_{N1-N5}$ and the current $I_{N1-N6}$ tend to be the same in value and opposite in direction, and the potential change of the first node N1 is small.

In some embodiments, in the case of ⅔≤|C1−C2|/|C1+C2|<1, the ranges of the capacitance C1 of the first capacitor c1 and the capacitance C2 of the second capacitor c2 can be: 5 fF≤C1<7 fF, and 0 fF<C2≤1 fF.

For example, C1=5 fF, C2=1 fF. As another example, C1=1 fF, C2=5 fF. As another example, C1=6 fF, C2=1 fF. As another example, C1=1 fF, C2=6 fF. As another example, C1=5 fF, C2=0.5 fF. As another example, C1=0.5 fF, C2=5 fF, etc.

In some embodiments, referring to FIGS. 4 and 5, a working process of the pixel circuit 10 includes a first moment t1. At the first moment t1, the potential of the intermediate node N5 of the first dual control module 12 is higher than the potential of the first node N1, and the potential of the first node N1 is higher than the potential of the intermediate node N6 of the second dual control module 13. As such, even if there is a leakage current among the first dual control module 12, the second dual control module 13, and the first node N1, the direction of the current flows from the intermediate node N5 to the first node N1, and flows from the first node N1 to the intermediate node N6. That is, the intermediate node N5 charges the first node N1, while the first node N1 discharges to the intermediate node N6, so as to prevent the intermediate node N5 and the intermediate node N6 from simultaneously charging the first node N1 or the first node N1 from simultaneously discharging the intermediate node N5 and the intermediate node N6, which causes the potential of the first node N1 to maintain dynamic balance.

Or, at the first moment t1, the potential of the intermediate node N5 of the first dual control module 12 is lower than the potential of the first node N1, and the potential of the first node N1 is lower than the potential of the intermediate node N6 of the second dual control module 13. Similarly, even if there is a leakage current among the first dual control module 12, the second dual control module 13, and the first node N1, the direction of the current flows from the intermediate node N1 to the first node N5, and flows from the first node N6 to the intermediate node N1. That is, the first node N1 discharges to the intermediate node N5, while the intermediate node N6 charges the first node N1, so as to prevent the intermediate node N5 and the intermediate node N6 from simultaneously charging the first node N1 or the first node N1 from simultaneously discharging the intermediate node N5 and the intermediate node N6, which causes the potential of the first node N1 to maintain dynamic balance.

In some embodiments, the first capacitor c1 and the second capacitor c2 can be set to make the absolute value of the difference between a first potential difference ΔC1 and a second potential difference ΔC2 less than 2V at the first moment t1. The first potential difference ΔC1 is the potential difference between the first node N1 and the intermediate node N5 of the first dual control module 12, and the second potential difference ΔC2 is the potential difference between the intermediate node N6 of the second dual control module 13 and the first node N1. This can avoid excessive charging of the intermediate node N5 to the first node N1, and avoid excessive discharge from the first node N1 to the intermediate node N6, or avoid excessive discharge from the first node N1 to the intermediate node N5, and avoid excessive charging of the intermediate node N6 to the first node N1, so that the potential of the first node N1 can better maintain dynamic balance.

Exemplarily, the first capacitor c1 and the second capacitor c2 can be set to make the absolute value of the difference between a first potential difference ΔC1 and a second potential difference ΔC2 less than or equal to 1V at the first moment. For example, the first potential difference ΔC1 may be less than or equal to 2V, and the second potential difference ΔC2 may be less than or equal to 3V.

In some embodiments, referring to FIGS. 4 and 5 again, the working process of the pixel circuit 10 includes the reset phase, the data writing phase, and the light emitting phase, where the data writing phase is between the reset phase and the light emitting phase. In the reset phase, the signal provided by the first scanning line S(n−1) controls the first dual control module 12 to turn on. In the data writing phase, the signal provided by the second scanning line Sn controls the second dual control module 13 to turn on. In the light emitting phase, the signal provided by the first scanning line S(n−1) controls the first dual control module 12 to turn off, the signal provided by the second scanning line Sn controls the second dual control module 13 to turn off, and the driving module 11 drives the light emitting module 15 according to the potential of the first node N1. The first moment t1 is after the data writing phase. In FIG. 5, the first dual control module 12 and the second dual control module 13 are turned on with the low voltage signal and turned off with the high voltage signal, which are not intended to limit the present disclosure.

The light emitting phase is after the data writing phase. If the potential of the first node N1 cannot be maintained stable in the light emitting phase, brightness of the light emitting module 15 will be affected, which causes the problem of screen flickering on the display panel. In the embodiments of the present disclosure, the first moment is after the data writing phase, and the potential of the first node N1 can better maintain dynamic balance at the first moment, so that it can avoid affecting the brightness of the light emitting module 15, thereby avoiding causing the problem of screen flickering on the display panel.

Exemplarily, the first moment t1 may be located at an early phase of the light emitting phase. In the example where the first dual control module 12 and the second dual control module 13 are turned on with the low voltage signal, as shown in FIGS. 4 and 5, the first capacitor c1 and the second capacitor c2 can maintain the potentials, so that the potential of the intermediate node N5 of the first dual control module 12 is lower than the potential of the first node N1, and the potential of the intermediate node N6 of the second dual control module 13 is higher than the potential of the first node N1, which causes the current to flow from the first node N1 to the intermediate node N5, and flow from the intermediate node N6 to the first node N1. That is, the first node N1 discharges to the intermediate node N5, while the intermediate node N6 charges the first node N1, thereby causing the potential of the first node N1 to maintain dynamic balance. However, as shown in FIG. 6, in which the first capacitor c1 and the second capacitor c2 are not provided, when the signal of the first scanning line S(n−1) changes from low voltage to high voltage, due to the coupling effect of the first parasitic capacitor, the potential of the first intermediate node N5 increases accordingly. When the signal of the second scanning line Sn changes from low voltage to high voltage, due to the coupling effect of the second parasitic capacitor, the potential of the second intermediate node N6 increases accordingly. As a result, the potentials of the intermediate nodes N5 and N6 are both higher than that of the first node N1 in the early phase of the light emitting phase. The current flows from the intermediate node N5 to the first node N1, and flows from the intermediate node N6 to the first node N1. That is, the intermediate nodes N5 and N6 both charge the first node N1, so that the potential of the first node N1 increases, which affects the brightness of the light emitting module 15.

In some embodiments, as shown in FIG. 4, the first dual control module 12 includes the first dual gate transistor T1, and the second dual control module 13 includes the second dual gate transistor T2. A gate of the first dual gate transistor T1 is connected to the first scanning line S(n−1), and one of source and drain of the first dual gate transistor T1 is connected to the first node N1. A gate of the second double gate transistor T2 is connected to the second scanning line Sn, one of source and drain of the second dual gate transistor T2 is connected to the first node N1, and the other of the source and drain of the second dual gate transistor T2 is connected to the first end of the driving module 11.

Figure 8:
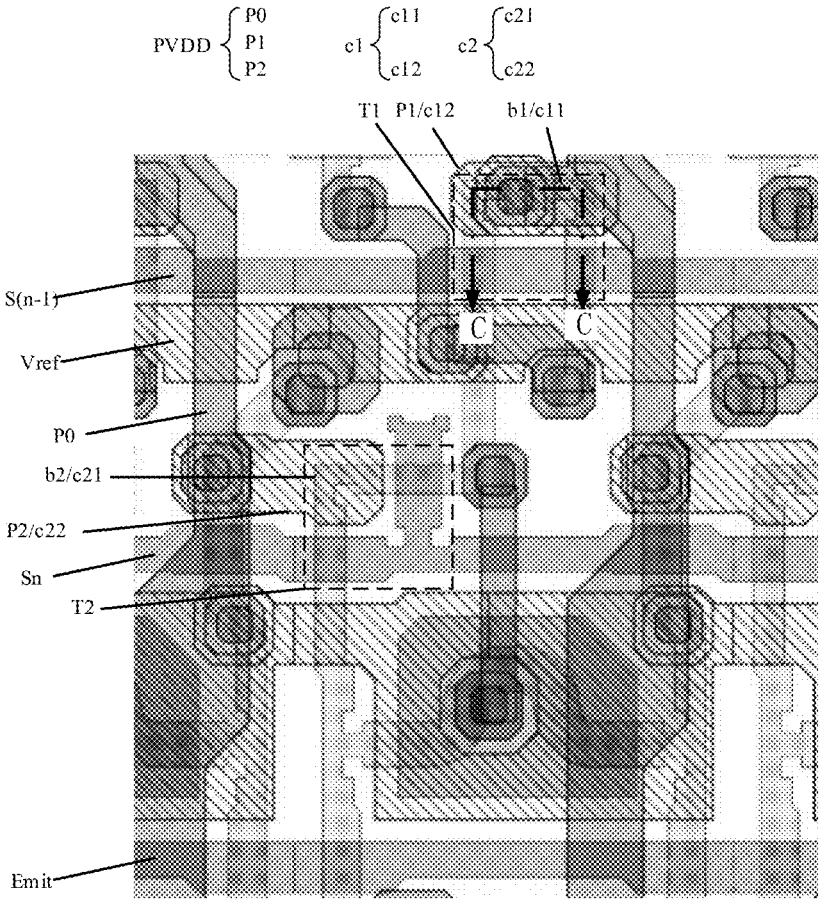
FIG. 8 illustrates a schematic top view of a partial layout of a display panel according to an embodiment of the present disclosure.

As shown in FIG. 8, an active layer b1 of the first dual gate transistor T1 can be multiplexed as a first electrode plate c11 of the first capacitor c1, and an active layer b2 of the second dual gate transistor T2 can be multiplexed as a first electrode plate c21 of the second capacitor c2. Exemplarily, in the example where the first dual gate transistor T1 includes the first sub-transistor T11 and the second sub-transistor T12 connected in series, and the second dual gate transistor T2 includes the third sub-transistor T21 and the fourth sub-transistor T22 connected in series, the first intermediate node N5 is the connection point between the first sub-transistor T11 and the second sub-transistor T12, and the second intermediate node N6 is the connection point between the third sub-transistor T21 and the fourth sub-transistor T22. For example, the second electrode of the first sub-transistor T11 and the first electrode of the second sub-transistor T12 are connected in the first intermediate node N5, and the second electrode of the third sub-transistor T21 and the first electrode of the fourth sub-transistor T22 are connected in the second intermediate node N6.

Exemplarily, the second electrode of the first sub-transistor T11, the first electrode of the second sub-transistor T12, and the first intermediate node N5 are all located in the semiconductor layer b and all include semiconductor materials. The active layer b1 of the first dual gate transistor T1 includes the second electrode of the first sub-transistor T11, the first electrode of the second sub-transistor T12, and the first intermediate node N5. The second electrode of the third sub-transistor T21, the first electrode of the fourth sub-transistor T22, and the second intermediate node N6 are all located in the semiconductor layer b and all include semiconductor materials. The active layer b2 of the second dual gate transistor T2 includes the second electrode of the third sub-transistor T21, the first electrode of the fourth sub-transistor T22, and the second intermediate node N6.

Figure 9:
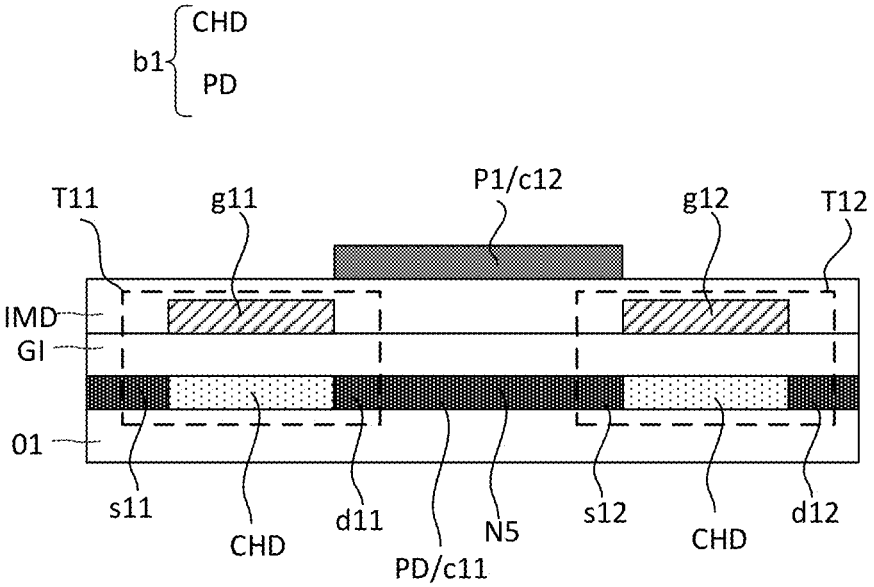
FIG. 9 illustrates a schematic cross-sectional view along C-C direction in FIG. 8.

In order to better described how the active layer is multiplexed as a capacitor plate, the first dual gate transistor T1 is taken as an example. As shown in FIG. 9, the active layer b1 of the first dual gate transistor T1 includes a heavily doped region PD and two lightly doped regions CHD, where each lightly doped region is provided with the heavily doped regions PD on two sides, and the heavily doped regions PD between the two lightly doped regions CHD can be connected as a whole.

In a direction perpendicular to the substrate 01, the two lightly doped regions CHD overlap with gates g11 and g12, respectively, where the gate g11 is a gate of the first sub-transistor T11, and g12 is a gate of the second sub-transistor T12. It can be understood that the two lightly doped regions CHD are channel regions of the first sub-transistor T11 and the second sub-transistor T12, respectively, and the heavily doped region PD is source region and drain region of the first sub-transistor T11 and the second sub-transistor T12. The source region and drain region of the first sub-transistor T11 may be used as a source s11 and a drain d11 of the first sub-transistor T11, respectively, and the source region and drain region of the second sub-transistor T12 may be used as a source s12 and a drain d12 of the second sub-transistor T12, respectively. Exemplarily, in the direction perpendicular to the substrate 01, the first scanning line S(n−1) overlaps with the two lightly doped regions CHD, and an overlapping part of the first scanning line S(n−1) and the two lightly doped regions CHD is the gate g11 of the first sub-transistor T11 and the gate g12 of the second sub-transistor T12.

The first intermediate node N5 is located in the heavily doped region PD between the two lightly doped regions CHD. Specifically, the heavily doped region PD between the two lightly doped regions CHD is multiplexed as the first electrode plate c11 of the first capacitor c1.

The active layer of the second dual gate transistor T2 is multiplexed as the first electrode plate of the second capacitor c2 in the same manner, which will not be described in detail herein.

In the embodiments of the present disclosure, the active layer of the first dual gate transistor T1 and the active layer of the second dual gate transistor T2 are multiplexed as the first electrode plates of the first capacitor c1 and the second capacitor c2, respectively. As such, it is not needed to additionally provide the first electrode plates of the first capacitor c1 and the second capacitor c2, which can simplify the structure of the display panel and reduce cost.

As shown in FIGS. 1 and 4, the display panel 100 includes the reference voltage line Vref, where the first dual control module 12 is connected between the first node N1 and the reference voltage line Vref, and the first dual control module 12 is configured to transmit a reference voltage of the reference voltage line Vref to the first node N1. It can be understood that the first dual control module 12 is configured to reset the potential of the first node N1, that is, to reset the potential of the control end of the driving module 11. In addition, the second dual control module 13 is configured to compensate a threshold voltage of the driving module 11.

Exemplarily, the first power line PVDD is configured to provide a power supply voltage, and voltage of the first power line PVDD may be a positive voltage, such as 4.6V. Voltage of the second power line PVEE may be a negative voltage, such as −2.5V. The reference voltage line Vref is configured to provide a reset voltage signal, and voltage of the reference voltage line Vref may be a negative voltage, such as −3.5V. In addition, a high voltage of the scanning signals transmitted by the first scanning line and the second scanning line may be 8V, and a low voltage may be −7V. A high voltage of the light emission control signal transmitted by the light emission control signal line can be 8V, and a low voltage can be −7V.

In some embodiments, one of the first power line PVDD, the second power line PVEE, and the reference voltage line Vref may be used as the first fixed potential line. And/or, one of the first power line PVDD, the second power line PVEE, and the reference voltage line Vref may be used as the second fixed potential line.

In the embodiments of the present disclosure, by using one of the first power line PVDD, the second power line PVEE, and the reference voltage line Vref as the first fixed potential line and/or the second fixed potential line, it is not needed to additionally provide a fixed potential line as the first fixed potential line and/or the second fixed potential line, which can simplify the structure of the display panel and reduce the cost.

In some embodiments, as shown in FIG. 2 or FIG. 3, the display panel 100 includes the substrate 01. In the direction perpendicular to the substrate 01, the first fixed potential line overlaps with the active layer of the first dual gate transistor T1. In the direction perpendicular to the substrate 01, the second fixed potential line overlaps with the active layer of the second dual gate transistor T2. Referring to FIG. 8, an example where the first power line PVDD is used as the first fixed potential line and the second fixed potential line is taken for description. The first power line PVDD includes a body member P0, a first branch member P1, and a second branch member P2. The first branch member P1 and the second branch member P2 are both electrically coupled to the body member P0, that is, signal potentials transmitted by the first branch member P1 and the second branch member P2 are both the same as signal potential transmitted by the body member P0. The first branch member P1 overlaps with the active layer b1 of the first dual gate transistor T1, and the second branch member P2 overlaps with the active layer b2 of the second dual gate transistor T2. It can be understood that the first member P1 is multiplexed as a second electrode plate C12 of the first capacitor c1, and the second branch member P2 is multiplexed as a second plate C22 of the second capacitor c2. That is, an overlapping part of the first fixed potential line and the active layer of the first dual gate transistor T1 is multiplexed as the second electrode plate C12 of the first capacitor c1, and an overlapped part of the second fixed potential line and the active layer of the second dual gate transistor T2 is multiplexed as the second electrode plate C22 of the second capacitor c2. As such, it is not needed to additionally provide the second electrode plates of the first capacitor and the second capacitor, which can simplify the structure of the display panel and reduce the cost.

Exemplarily, the body member P0 of the first power line PVDD may be located in the source drain metal layer M2, the first branch member P1 and the second branch member P2 may be located in the capacitor metal layer MC, and the first branch member P1 and the second branch member P2 are connected to the body member P0 of the first power line PVDD by via holes.

FIG. 8 only illustrates a case where the first power line PVDD is used as the first fixed potential line and the second fixed potential line. In another case where the reference voltage line Vref is used as the first fixed potential line and/or the second fixed potential line, the reference voltage line Vref can also be set to include a body member and branch members overlapping with the active layer of the first dual gate transistor T1 and/or the active layer of the second dual gate transistor T2, respectively. Exemplarily, the body member and the branch members of the reference voltage line Vref may all be located in the capacitor metal layer MC.

In some embodiments, the first fixed potential line and the second fixed potential line are configured to provide the same potential. For example, the first fixed potential line and the second fixed potential line can be configured to provide the same positive potential or the same negative potential. The first power line PVDD can be used as the first fixed potential line and the second fixed potential line at the same time, or the reference voltage line Vref can be used as the first fixed potential line and the second fixed potential line at the same time, or the second power line PVEE can be used as the first fixed potential line and the second fixed potential line at the same time. When the first fixed potential line and the second fixed potential line provide the same potential, the capacitances of the first capacitor c1 and the second capacitor c2 can be easily controlled.

In some other embodiments, the first fixed potential line and the second fixed potential line are respectively configured to provide different potentials. For example, the first power line PVDD is used as the first fixed potential line, and the reference voltage line Vref or the second power line PVEE is used as the second fixed potential line.

Figure 10:
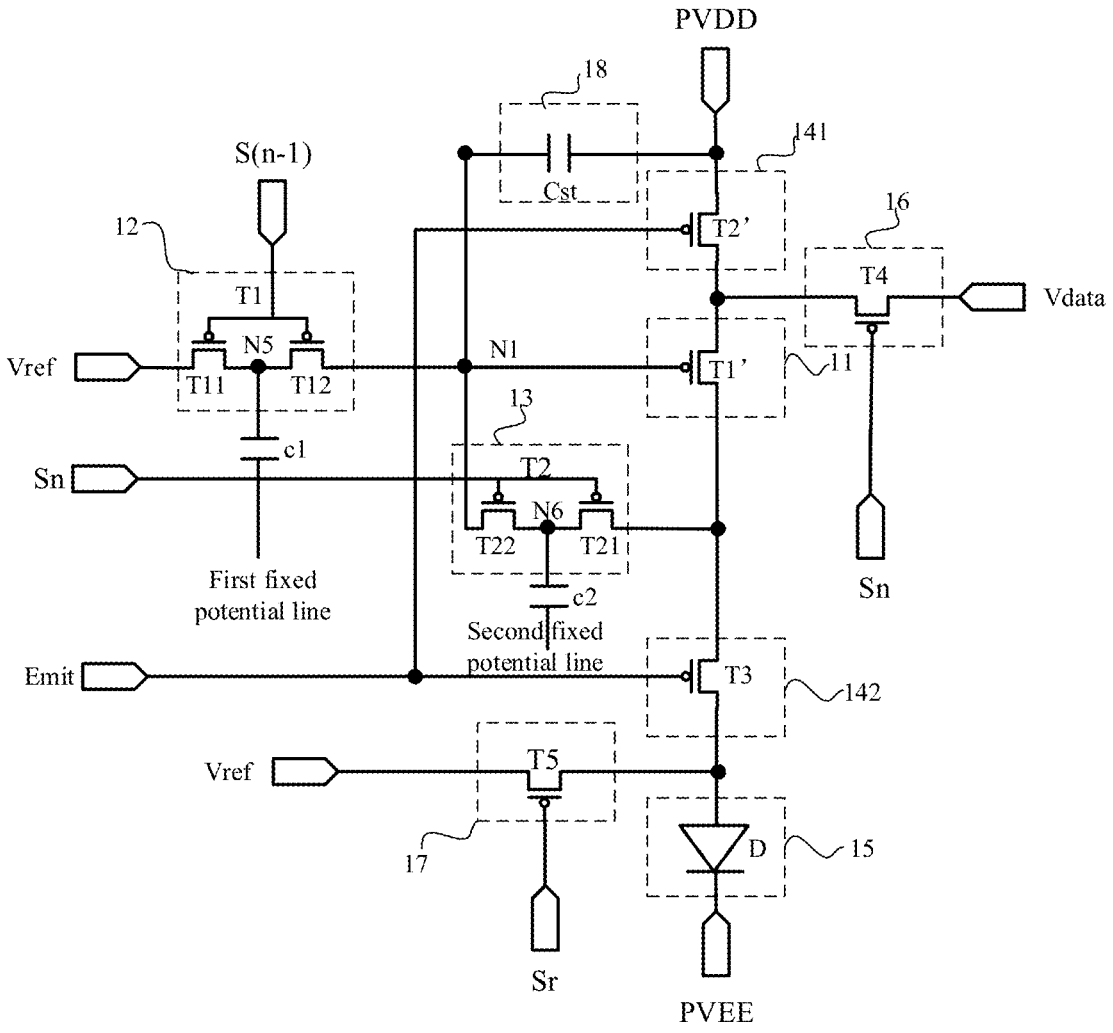
FIG. 10 illustrates a schematic circuit structure diagram of a pixel circuit according to another embodiment of the present disclosure.
Figure 11:
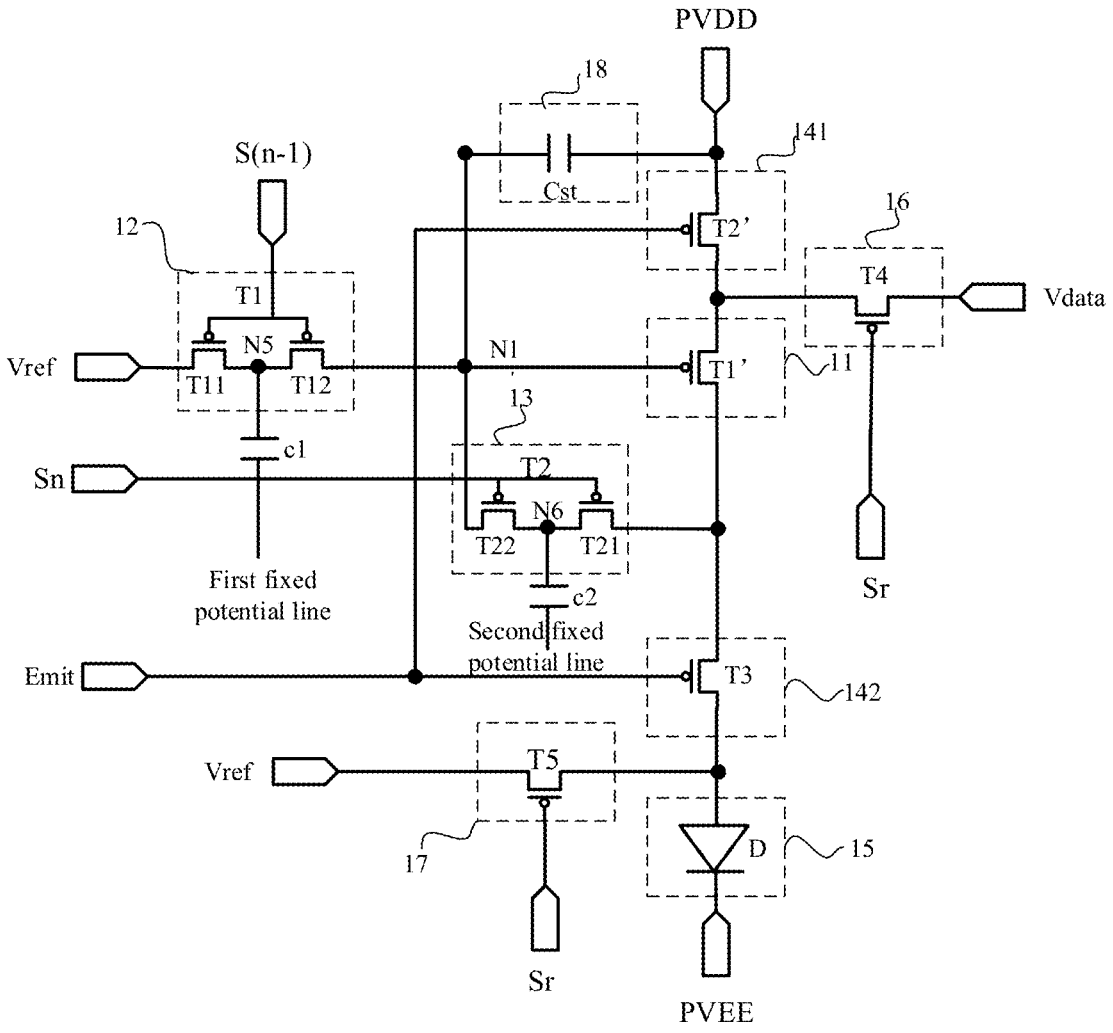
FIG. 11 illustrates a schematic circuit structure diagram of a pixel circuit according to another embodiment of the present disclosure.

In some embodiments, as shown in FIG. 10 or FIG. 11, the pixel circuit 10 also includes a data writing module 16, a reset module 17, a light emission control module 14, and a storage module 18, where the light emission control module 14 includes a first light emission control module 141 and a second light emission control module 142.

Specifically, the driving module 11 includes a first transistor T1', and a gate of the first transistor T1' is connected to the first node N1.

The first light emission control module 141 includes a second transistor T2', where a first electrode of the second transistor T2' is connected to the first power line PVDD, a second electrode of the second transistor T2' is connected to a first electrode of the first transistor T1', and a gate of the second transistor T2' is connected to the light emission control signal line Emit. The second light emission control module 142 includes a third transistor T3, where a first electrode of the third transistor T3 is connected to a second electrode of the first transistor T1', a second electrode of the third transistor T3 is connected to the light emitting module 15, and a gate of the third transistor T3 is connected to the light emission control signal line Emit. The data writing module 16 includes a fourth transistor T4, where a first electrode of the fourth transistor T4 is connected to the data signal line Vdata, a second electrode of the fourth transistor T4 is connected to the first electrode of the first transistor T1', and a gate of the fourth transistor T4 is connected to the second scanning line Sn or a third scanning line Sr. The reset module 17 includes a fifth transistor T5, where a first electrode of the fifth transistor T5 is connected to the reference voltage line Vref, a second electrode of the fifth transistor T5 is connected to the light emitting module 15, and a gate of the fifth transistor T5 is connected to the third scanning line Sr. The first dual control module 12 includes the first dual gate transistor T1, where a first electrode of the first dual gate transistor T1 is connected to the reference voltage line Vref, a second electrode of the first dual gate transistor T1 is connected to the first node N1, and the gate of the first dual gate transistor T1 is connected to the first scanning line S(n−1). The second dual control module 13 includes the second dual gate transistor T2, where a first electrode of the second dual gate transistor T2 is connected to the second electrode of the first transistor T1', a second electrode of the second dual gate transistor T2 is connected to the first node N1, and a gate of the second dual gate transistor T2 is connected to the second scanning line Sn. The light emitting module 15 includes a light-emitting diode D, where a first electrode of the light-emitting diode D is connected to the second electrode of the third transistor T3 and the second electrode of the fifth transistor T5, and a second electrode of the light-emitting diode D is connected to the second power line PVEE. The storage module 18 includes a storage capacitor Cst, where a first electrode plate of the storage capacitor Cst is connected to the first power line PVDD, and a second electrode plate of the storage capacitor Cst is connected to the first node N1.

The first electrode of the light-emitting diode D may be an anode, and the second electrode of the light-emitting diode D may be a cathode.

Exemplarily, the second scanning line Sn may be multiplexed as the third scanning line Sr, that is, signal of the third scanning line Sr and the signal of the second scanning line Sn may be the same.

In order to describe the working process of the pixel circuit 10 more clearly, below is an example for description where the second scanning line Sn is multiplexed as the third scanning line Sr, and the transistors of the pixel circuit are all P-type transistors. Referring to FIGS. 5 and 10, in the reset phase, the first scanning line S(n−1) provides the low voltage signal, the first dual gate transistor T1 is turned on, and gate potential of the first transistor T1' is reset. In the data writing phase, the second scanning line Sn provides the low voltage signal, and the fourth transistor T4 and the second dual gate transistor T2 are turned on. A data signal of the data signal line Vdata is input to the gate of the first transistor T1', and threshold voltage of the first transistor T1' is compensated. The fifth transistor T5 is turned on, and potential of the first electrode of the light-emitting diode is reset. In the light emitting phase, the light emission control signal line Emit provides the low voltage signal, the second transistor T2' and the third transistor T3 are turned on, driving current generated by the first transistor T1' is transmitted to the light-emitting diode, and the light-emitting diode emits light.

The signal of the third scanning line Sr and the signal of the second scanning line Sn may be different, that is, the signal of the third scanning line Sr may be controlled separately.

Figure 12:
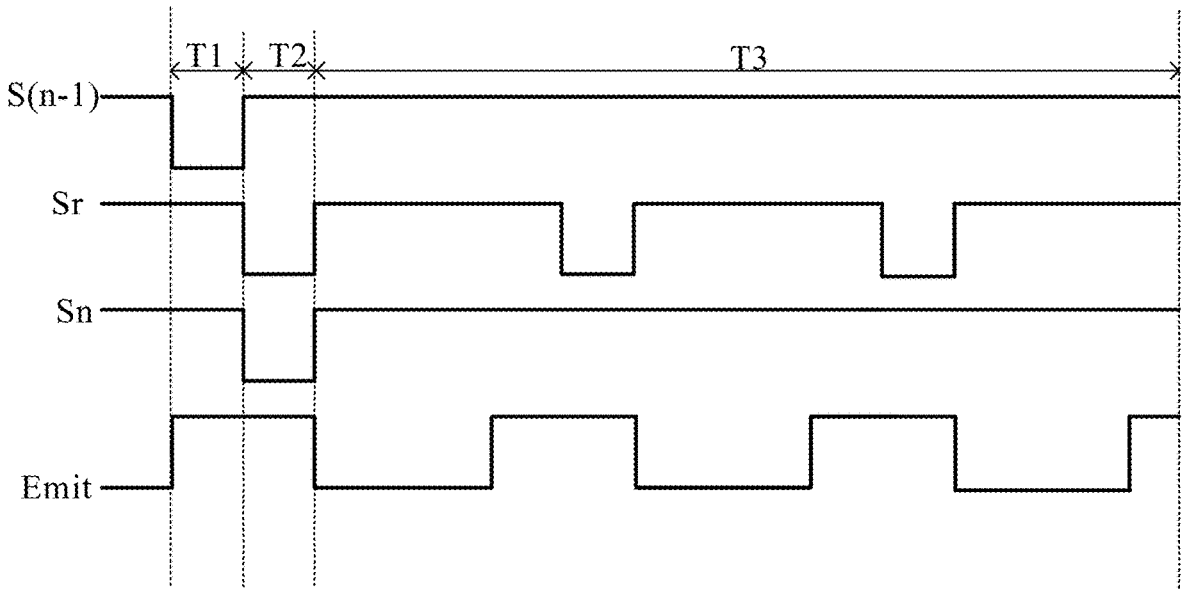
FIG. 12 illustrates a timing diagram of FIG. 10.

Below is an example for description where the signal of the third scanning line Sr and the signal of the second scanning line Sn is different, the gate of the fourth transistor T4 is connected to the second scanning line Sn, and specifically, all the transistors of the pixel circuit are P-type transistors. Referring to FIGS. 10 and 12, in the reset phase, the first scanning line S(n−1) provides the low voltage signal, the first dual gate transistor T1 is turned on, and the gate potential of the first transistor T1' is reset. In the data writing phase, the second scanning line Sn provides the low voltage signal, and the fourth transistor T4 and the second dual gate transistor T2 are turned on. The data signal of the data signal line Vdata is input to the gate of the first transistor T1', and the threshold voltage of the first transistor T1' is compensated. The third scanning line Sr provides the low voltage signal, the fifth transistor T5 is turned on, and the potential of the first electrode of the light-emitting diode is reset. In the light emitting phase, the light emission control signal line Emit provides a low voltage and high voltage alternating signal, and the third scanning line Sr provides a low voltage and high voltage alternating signal. When the light emission control signal line Emit provides the low voltage signal, the third scanning line Sr provides the high voltage signal. When the light emission control signal line Emit provides the high voltage signal, the third scanning line Sr provides the low voltage signal, and high voltage duration of the light emission control signal line Emit is greater than or equal to low voltage duration of the third scanning line Sr. When the light emission control signal line Emit provides the low voltage signal, the second transistor T2' and the third transistor T3 are turned on, the driving current generated by the first transistor T1' is transmitted to the light-emitting diode, and the light-emitting diode emits light. When the third scanning line Sr provides the low voltage signal, the fifth transistor T5 is turned on, and the potential of the first electrode of the light-emitting diode is reset. It can be understood that in the light emitting phase, the fifth transistor T5 is turned on multiple times, so that the potential of the first electrode of the light-emitting diode is reset multiple times, which further improves the problem of flickering of the display panel in the low-frequency display mode.

Below is an example for description where the signal of the third scanning line Sr and the signal of the second scanning line Sn is different, and the gate of the fourth transistor T4 is connected to the third scanning line Sr. The working process of the display panel may include data input frame and holding frame. The data signal line Vdata can provide data signal and adjustment voltage. In the data input frame, the pixel circuit performs as in the data writing phase and the light emitting phase. In the data writing phase, the data writing module 16 and the second dual gate transistor T2 are turned on, and the data writing module inputs the data signal. In the holding frame, the pixel circuit performs as in a reset adjustment phase and the light emitting phase. In the reset adjustment phase, the data writing module 16 is turned on, the second dual gate transistor T2 is turned off, and the data writing module inputs the adjustment voltage for adjusting and driving a bias state of the transistor.

Figure 13:
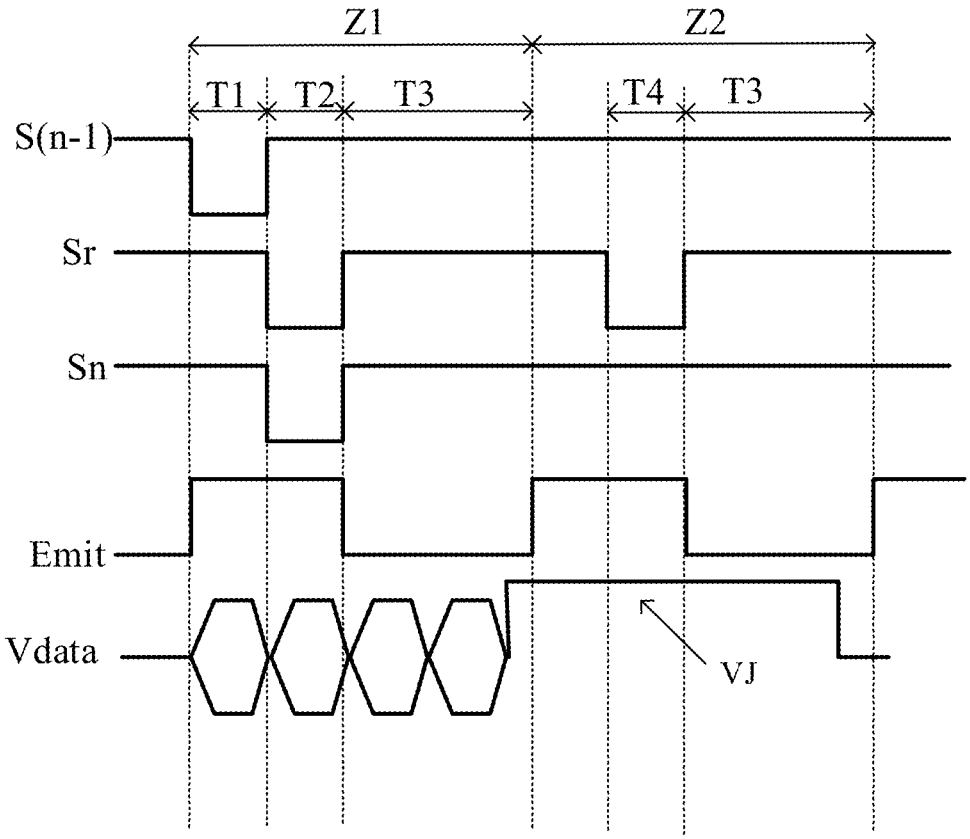
FIG. 13 illustrates a timing diagram of FIG. 11.

Specifically, an example where the transistors of the pixel circuit are all P-type transistors is taken for description. Referring to FIGS. 11 and 13, in data input frame Z1, the pixel circuit performs as in a reset phase T1, a data writing phase T2, and a light emitting phase T3. The reset phase T1 is before the data writing phase T2. In the reset phase T1, the first dual gate transistor T1 is turned on, and the gate of the first transistor T1' is reset, so as to ensure that an accurate data voltage is input to the gate of the first transistor T1' when the display panel performs as in the data input frame Z1. In the data writing phase T2, the data writing module 16 and the second dual gate transistor T2 are turned on, the data signal is input to the gate of the first transistor T1', and the second dual gate transistor T2 compensates to the threshold voltage of the first transistor T1'. Specifically, the data writing module 16 is turned on under the control of the signal of the third scanning line Sr, and inputs the signal provided by the data signal line Vdata to a source of the first transistor T1'. The second dual gate transistor T2 is turned on under the control of the signal of the second scanning line Sn, and provides drain voltage of the first transistor T1' to the gate of the first transistor T1'. In the light emitting phase T3, the light emission control module 14 is turned on under the control of a signal of the light emission control signal line Emit, and provides the driving current generated by the first transistor T1' to the light-emitting diode D.

In holding frame Z2, the pixel circuit performs as in a reset adjustment phase T4 and the light emitting phase T3. In the reset adjustment phase T4, the data writing module 16 is turned on, the second dual gate transistor T2 is turned off, and the data writing module 16 inputs an adjustment voltage VJ for adjusting the bias state of the first transistor T1'. Specifically, the data writing module 16 is turned on under the control of the signal of the third scanning line Sr, and inputs the adjustment voltage VJ passed by the data signal line Vdata to the source of the first transistor T1', so as to adjust the bias state of the first transistor T1'. The working process of the pixel circuit in the light emitting phase T3 in the holding frame Z2 is the same as the working process of the light emitting phase T3 in the data input frame Z1.

There is a process of increasing brightness in an initial emission phase of the light-emitting diode D, and speed of the increasing brightness is associated with the bias state of first transistor T1'.

The data input frame Z1 includes a phase of resetting the gate of the first transistor T1', and the bias state of the first transistor T1' is affected after a voltage signal VR of the reference voltage line Vref is provided to the gate of the first transistor T1'. In the beginning of the data writing phase T2, gate voltage of the first transistor T1' is VR, source voltage of the first transistor T1' remains as the voltage in a previous light emitting phase, which is close to voltage VP provided by the first power line PVDD. As such, the gate voltage relative to the source voltage of the first transistor T1' is $Vgs1=VR-VP$.

The display panel provided by the present disclosure includes the holding frame Z2 during operation. The holding frame Z2 includes the reset adjustment phase T4. In the reset adjustment phase T4, the data writing module 16 inputs the adjustment voltage VJ to the source of the first transistor T1', and then in this phase, the source voltage of the first transistor T1' is close to VJ, while the gate of the first transistor T1' remains the potential of the previous light emitting phase, so that the gate voltage of the first transistor T1' is close to VData+Vth, and VData is the data voltage. As such, the gate voltage relative to the source voltage of the first transistor T1' is Vgs2=VData+Vth−VJ. In the present disclosure, the bias state of the first transistor T1' is adjusted by controlling the adjustment voltage VJ, which reduces the difference between Vgs2 and Vgs1 to make Vgs2 and Vgs1 close. It is equivalent to inputting the adjustment voltage VJ to the source of the first transistor T1' in the reset adjustment phase T4 to simulate the bias state of the first transistor T1' in the data input frame Z1, so as to reduce the speed of the increasing brightness of the light-emitting diode D in the holding frame Z2, which makes the speed of the increasing brightness of the light emission element in the holding frame Z2 and the speed of the increasing brightness of the light emission element in the data input frame Z1 tend to be consistent, thereby solving the flickering problem of display screen.

In some embodiments, VP=4.6V and 6V≤VJ≤8V. VJ is set to be greater than VP, and VJ is not too large, so as to avoid excessive power consumption.

In addition, FIGS. 12 and 13 show the example where the third scanning line Sr provides the low voltage in the data writing phase T2 and provides the high voltage in the reset phase T1. It can be understood that the third scanning line Sr may also provide the high voltage in the data writing phase T2 and provide the low voltage in the reset phase T1, which are not limited in the present disclosure.

In some embodiments, the first transistor T1', the second transistor T2', the fourth transistor T4, the first dual gate transistor T1, the second dual gate transistor T2, the third transistor T3, and the fifth transistor T5 are all P-type transistors. When the transistors are of the same type, manufacturing difficulty of the display panel can be reduced.

In some embodiments, materials of the active layers of the first transistor T1', the second transistor T2', the fourth transistor T4, the first dual gate transistor T1, the second dual gate transistor T2, the third transistor T3, and the fifth transistor T5 all include poly-silicon. For example, materials of the active layers of the first transistor T1', the second transistor T2', the fourth transistor T4, the first dual gate transistor T1, the second dual gate transistor T2, the third transistor T3, and the fifth transistor T5 all include low temperature poly-silicon. The poly-silicon transistor has a relatively high mobility, which can improve the driving capability of the pixel circuit.

Figure 14:
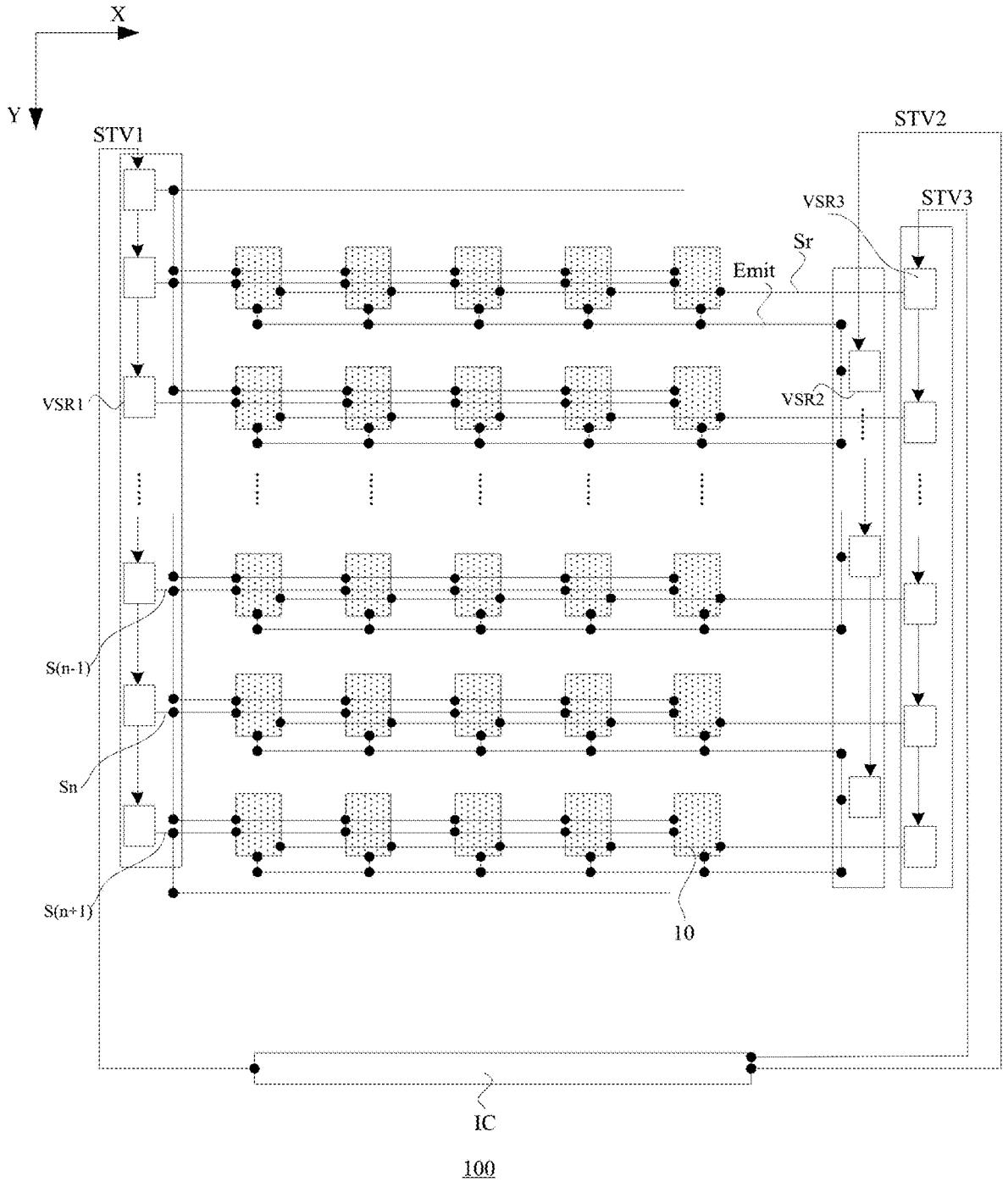
FIG. 14 illustrates a schematic top view of a display panel according to another embodiment of the present disclosure.

In some embodiments, as shown in FIG. 14, the display panel 100 includes multiple stages of first shift register VSR1, multiple stages of second shift register VSR2, and multiple stages of third shift register VSR3. The first shift register VSR1 and the second shift register VSR2 shown in FIG. 14 may be the same as the first shift register VSR1 and the second shift register VSR2 shown in FIG. 1 as described above, which will not be repeated herein.

The third shift register VSR3 in each stage provides a scanning signal to a single row of the pixel circuits 10. Exemplarily, the third shift register VSR3 may be electrically coupled to the gates of the fourth transistor T4 and the fifth transistor T5 in the pixel circuit 10 via the third scanning line Sr. The driver chip IC provides a third start signal STV3 for the third shift register VSR3.

In addition, a clock signal line (not shown in the figure), a high voltage signal line VGH (not shown in the figure), and a low voltage signal line VGL (not shown in the figure) may be connected between the third shift register VSR3 and the driver chip IC, where the driver chip IC provides a clock signal, a high voltage signal, and a low voltage signal to the third shift register VSR3.

For example, as shown in FIG. 14, the display panel 100 may include one first shift register VSR1, one second shift register VSR2, and one third shift register VSR3, where the first shift register VSR1, the second shift register VSR2, and the third shift register VSR3 may be arranged on opposite sides of the display panel 100 in the second direction Y, or the first shift register VSR1, the second shift register VSR2, and the third shift register VSR3 may also be arranged on the same side.

As another example, the display panel 100 may also include two first shift registers VSR1, two second shift registers VSR2, and third shift registers VSR3, where two ends of the first scanning line and the second scanning line are electrically coupled to the two first shift registers VSR1 respectively, and two ends of the light emission control signal line Emit are electrically coupled to the two second shift registers VSR2 respectively, and two ends of the third scanning line are electrically coupled to the two third shift registers VSR3.

In some embodiments, referring to FIGS. 1 and 4, the embodiments of the present disclosure also provide a display panel that includes pixel circuits. The similarities between the pixel circuit and the pixel circuit 10 in the embodiments described above will not be repeated herein. The difference is that the capacitance C1 of the first capacitor and the capacitance C2 of the second capacitor can be set as: 2 fF<C1<7 fF, and 0 fF<C2<4 fF. In the embodiments of the present disclosure, the capacitance C1 of the first capacitor and the capacitance C2 of the second capacitor may be equal, such as C1=C2=2.5 fF, or C1=C2=3 fF, etc.

In the embodiments of the present disclosure, on one hand, the first capacitor c1 connected between the first intermediate node N5 and the first fixed potential line and the second capacitor c2 connected between the second intermediate node N6 and the second fixed potential line are added. When the signal of the first scanning line S(n−1) changes from low voltage to high voltage, due to the coupling effect of the first parasitic capacitor, the potential of the first intermediate node N5 tends to increase. However, the first capacitor c1 is electrically coupled to the first fixed potential line, and due to a coupling effect of the first capacitor c1, the potential of the first intermediate node N5 tends to remain unchanged. Therefore, due to the existence of the first capacitor c1, increasing amplitude of the potential of the first intermediate node N5 can be reduced or the potential of the first intermediate node N5 can remain unchanged. Similarly, when the signal of the second scanning line Sn changes from low voltage to high voltage, due to the coupling effect of the second parasitic capacitor, the potential of the second intermediate node N6 tends to increase. However, the second capacitor c2 is electrically coupled to the second fixed potential line, and due to a coupling effect of the second capacitor c2, the potential of the second intermediate node N6 tends to remain unchanged. Therefore, due to the existence of the second capacitor c2, increasing amplitude of the potential of the second intermediate node N6 can be reduced or the potential of the second intermediate node N6 can remain unchanged. On the other hand, the capacitance C1 of the first capacitor c1 and the capacitance C2 of the second capacitor c2 may be equal or not equal, that is, a degree to which the first capacitor c1 maintains the potential of the first intermediate node N5 is different from a degree to which the second capacitor c2 maintains the potential of the second intermediate node N6. For example, when the current $I_{N1-N5}$ is equal to the current $I_{N1-N6}$, the capacitance C1 of the first capacitor c1 can be set equal to the capacitance C2 of the second capacitor c2, so that the current $I_{N1-N5}$ remains equal to the current $I_{N1-N6}$, which makes the potential of the first node N1 maintain dynamic balance.

It should be noted that, the embodiments described above can be combined with each other when there is no conflict there-between.

Figure 15:
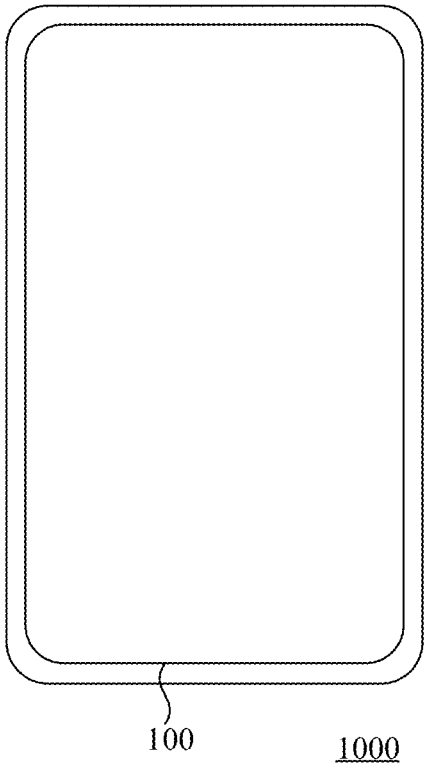
FIG. 15 illustrates a schematic structural diagram of a display device according to an embodiment of the present disclosure.

The present disclosure also provides a display device that includes the display panel provided by the present disclosure. Referring to FIG. 15, FIG. 15 is a schematic structural diagram of a display device according to an embodiment of the present disclosure. A display device 1000 provided in FIG. 15 includes the display panel 100 provided in any embodiment of the present disclosure described above. The embodiment of FIG. 15 only uses a mobile phone as an example to describe the display device 1000. It can be understood that the display device provided by the embodiments of the present disclosure may be a wearable product, a computer, a television, a vehicle display device, or another display device with display function, which are not specifically limited in the present disclosure. The display device provided in the embodiments of the present disclosure has the beneficial effects of the display panel provided in the embodiments of the present disclosure. For more details, reference may be made to the specific description of the display panel in the embodiments described above, which will not be repeated herein.

Obviously, those skilled in the art can make various changes and modifications to the present disclosure without departing from the spirit and scope of the present disclosure. As such, if the changes and modifications of the present disclosure fall within the scope of the claims of the present disclosure and their equivalent technologies, the present disclosure is also intended to include the changes and modifications.

What is claimed is:

1. A display panel comprising:

a pixel circuit including:

a light emitting module;

a driving module configured to drive the light emitting module to emit light, the driving module and the light emitting module being connected in series between a first power line and a second power line, and a control end of the driving module being connected to a first node;

a first dual control module, a control end of the first dual control module being connected to a first scanning line, a first end of the first dual control module being connected to the first node, and a first capacitor being formed between an intermediate node of the first dual control module and a first potential line; and a second dual control module, a control end of the second dual control module being connected to a second scanning line, a first end of the second dual control module being connected to the first node, a second end of the second dual control module being connected to a first end of the driving module, and a second capacitor being formed between an intermediate node of the second dual control module and a second potential line;

wherein capacitance of the first capacitor is C1, capacitance of the second capacitor is C2, and one of C1 and C2 is greater than another.

2. The display panel of claim 1, wherein 0 fF<C1<8 fF, and 0 fF<C2<8 fF.

3. The display panel of claim 2, wherein 4 fF≤C1+C2≤8 fF.

4. The display panel of claim 1, wherein 0<|C1−C2|/|C1+C2|≤⅓.

5. The display panel of claim 4, wherein 2 fF≤C1≤4 fF, and 2 fF≤C2≤4 fF.

6. The display panel of claim 1, wherein ⅔≤|C1−C2|/|C1+C2|<1.

7. The display panel of claim 6, wherein 5 fF≤C1<7 fF, and 0 fF<C2≤1 fF.

8. The display panel of claim 1, wherein:

a working process of the pixel circuit includes a first moment; and at the first moment, a potential of the intermediate node of the first dual control module is higher than a potential of the first node, and the potential of the first node is higher than a potential of the intermediate node of the second dual control module; or at the first moment, the potential of the intermediate node of the first dual control module is lower than the potential of the first node, and the potential of the first node is lower than the potential of the intermediate node of the second dual control module.

9. The display panel of claim 8, wherein the first capacitor and the second capacitor are configured to make an absolute value of a difference between a first potential difference and a second potential difference less than 2V at the first moment, the first potential difference being a potential difference between the first node and the intermediate node of the first dual control module, and the second potential difference being a potential difference between the intermediate node of the second dual control module and the first node.

10. The display panel of claim 8, wherein:

the working process of the pixel circuit includes a reset phase, a data writing phase, and a light emitting phase;

in the reset phase, a signal provided by the first scanning line controls the first dual control module to turn on;

in the data writing phase, a signal provided by the second scanning line controls the second dual control module to turn on;

in the light emitting phase, the signal provided by the first scanning line controls the first dual control module to turn off, the signal provided by the second scanning line controls the second dual control module to turn off, and the driving module drives the light emitting module according to the potential of the first node; and the first moment is after the data writing phase.

11. The display panel of claim 1, wherein:

the first dual control module includes a first dual gate transistor, a gate of the first dual gate transistor being connected to the first scanning line, one of source and drain of the first dual gate transistor being connected to the first node, and an active layer of the first dual gate transistor being multiplexed as a first electrode plate of the first capacitor; and the second dual control module includes a second dual gate transistor, a gate of the second dual gate transistor being connected to the second scanning line, one of source and drain of the second dual gate transistor being connected to the first node, another of the source and the drain of the second dual gate transistor being connected to the first end of the driving module, and an active layer of the second dual gate transistor being multiplexed as a first electrode plate of the second capacitor.

12. The display panel of claim 11, further comprising:
a substrate;
wherein:
in a direction perpendicular to the substrate, the first potential line overlaps with the active layer of the first dual gate transistor; and
in a direction perpendicular to the substrate, the second potential line overlaps with the active layer of the second dual gate transistor.

13. The display panel of claim 11, further comprising:
a reference voltage line;
wherein:
the first dual control module is configured to transmit a reference voltage of the reference voltage line to the first node; and
one of the first power line, the second power line, and the reference voltage line is the first potential line; and/or one of the first power line, the second power line, and the reference voltage line is the second potential line.

14. The display panel of claim 1, wherein the first potential line and the second potential line are configured to provide a same potential.

15. The display panel of claim 1, wherein the first potential line and the second potential line are respectively configured to provide different potentials.

16. The display panel of claim 1, wherein:
the pixel circuit further includes a data writing module, a reset module, a light emission control module including a first light emission control module and a second light emission control module, and a storage module;
the driving module includes a first transistor, a gate of the first transistor being connected to the first node;
the first light emission control module includes a second transistor, a first electrode of the second transistor being connected to the first power line, a second electrode of the second transistor being connected to a first electrode of the first transistor, and a gate of the second transistor being connected to a light emission control signal line;
the second light emission control module includes a third transistor, a first electrode of the third transistor being connected to a second electrode of the first transistor, a second electrode of the third transistor being connected to the light emitting module, and a gate of the third transistor being connected to the light emission control signal line;
the data writing module includes a fourth transistor, a first electrode of the fourth transistor being connected to a data signal line, a second electrode of the fourth transistor being connected to the first electrode of the first transistor, and a gate of the fourth transistor being connected to the second scanning line or a third scanning line;
the reset module includes a fifth transistor, a first electrode of the fifth transistor being connected to a reference voltage line, a second electrode of the fifth transistor being connected to the light emitting module, and a gate of the fifth transistor being connected to the third scanning line;
the first dual control module includes a first dual gate transistor, a first electrode of the first dual gate transistor being connected to the reference voltage line, a second electrode of the first dual gate transistor being connected to the first node, and a gate of the first dual gate transistor being connected to the first scanning line;
the second dual control module includes a second dual gate transistor, a first electrode of the second dual gate transistor being connected to the second electrode of the first transistor, a second electrode of the second dual gate transistor being connected to the first node, and a gate of the second dual gate transistor being connected to the second scanning line;
the light emitting module includes a light-emitting diode, a first electrode of the light-emitting diode being connected to the second electrode of the third transistor and the second electrode of the fifth transistor, and a second electrode of the light-emitting diode being connected to the second power line; and
the storage module includes a storage capacitor, a first electrode plate of the storage capacitor being connected to the first power line, and a second electrode plate of the storage capacitor being connected to the first node.

17. The display panel of claim 16, wherein materials of active layers of the first transistor, the second transistor, the third transistor, the fourth transistor, the fifth transistor, the first dual gate transistor, and the second dual gate transistor all include silicon.

18. The display panel of claim 16, further comprising:
a multistage first shift register, the multistage first shift register in each stage providing a signal to the second scanning line connected to the pixel circuits in a current row, and providing a signal to the first scanning line connected to the pixel circuits in a next row;
a multistage second shift register, the multistage second shift register in each stage providing a signal to the light emission control signal line connected to the pixel circuits in current two rows; and
a multistage third shift register, the multistage third shift register in each stage providing a signal to the third scanning line connected to the pixel circuits in a current row.

19. A display panel comprising:
a pixel circuit including:
a light emitting module;
a driving module configured to drive the light emitting module to emit light, the driving module and the light emitting module being connected in series between a first power line and a second power line, and a control end of the driving module being connected to a first node;
a first dual control module, a control end of the first dual control module being connected to a first scanning line, a first end of the first dual control module being connected to the first node, and a first capacitor being between an intermediate node of the first dual control module and a first potential line; and
a second dual control module, a control end of the second dual control module being connected to a second scanning line, a first end of the second dual control module being connected to the first node, a second end of the second dual control module being connected to a first end of the driving module, and a second capacitor being between an intermediate node of the second dual control module and a second potential line;
wherein capacitance of the first capacitor is C1, capacitance of the second capacitor is C2, and 2 fF<C1<7 fF and 0 fF<C2<4 fF.

20. A display device comprising:

a display panel including a pixel circuit including:

a light emitting module;

a driving module configured to drive the light emitting module to emit light, the driving module and the light emitting module being connected in series between a first power line and a second power line, and a control end of the driving module being connected to a first node;

a first dual control module, a control end of the first dual control module being connected to a first scanning line, a first end of the first dual control module being connected to the first node, and a first capacitor being between an intermediate node of the first dual control module and a first potential line; and a second dual control module, a control end of the second dual control module being connected to a second scanning line, a first end of the second dual control module being connected to the first node, a second end of the second dual control module being connected to a first end of the driving module, and a second capacitor being between an intermediate node of the second dual control module and a second potential line;

wherein capacitance of the first capacitor is C1, capacitance of the second capacitor is C2, and one of C1 and C2 is greater than the other.

* * * * *